US010564557B2

(12) United States Patent
Miyakoshi et al.

(10) Patent No.: US 10,564,557 B2
(45) Date of Patent: Feb. 18, 2020

(54) TONER, TONER STORED UNIT, IMAGE FORMING APPARATUS, AND IMAGE FORMING METHOD

(71) Applicants: Ryo Miyakoshi, Shizuoka (JP); Daisuke Asahina, Shizuoka (JP); Yoshihiro Moriya, Shizuoka (JP); Satoshi Kojima, Kanagawa (JP); Satoshi Takahashi, Kanagawa (JP)

(72) Inventors: Ryo Miyakoshi, Shizuoka (JP); Daisuke Asahina, Shizuoka (JP); Yoshihiro Moriya, Shizuoka (JP); Satoshi Kojima, Kanagawa (JP); Satoshi Takahashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/955,094

(22) Filed: Apr. 17, 2018

(65) Prior Publication Data

US 2018/0231902 A1 Aug. 16, 2018

Related U.S. Application Data

(63) Continuation of application No. PCT/JP2016/076042, filed on Sep. 5, 2016.

(30) Foreign Application Priority Data

Oct. 29, 2015 (JP) ..... 2015-213350

(51) Int. Cl.
*G03G 9/087* (2006.01)
*G03G 9/08* (2006.01)

(52) U.S. Cl.
CPC ..... *G03G 9/08755* (2013.01); *G03G 9/0821* (2013.01); *G03G 9/08795* (2013.01); *G03G 9/08797* (2013.01); *G03G 2215/0617* (2013.01)

(58) Field of Classification Search
CPC ..... G03G 9/08755; G03G 9/08797; G03G 9/0821; G03G 9/08795; G03G 2215/0617
See application file for complete search history.

(56) References Cited

U.S. PATENT DOCUMENTS

2006/0210899 A1 9/2006 Nakazawa et al.
2006/0216626 A1 9/2006 Sacripante et al.
(Continued)

FOREIGN PATENT DOCUMENTS

EP 1 705 524 A1 9/2006
EP 2 833 209 A1 2/2015
(Continued)

OTHER PUBLICATIONS

International Search Report dated Oct. 11, 2016 for counterpart International Patent Application No. PCT/JP2016/076042 filed Sep. 5, 2016 (with English Translation).
(Continued)

*Primary Examiner* — Thorl Chea
(74) *Attorney, Agent, or Firm* — Oblon, McClelland, Maier & Neustadt, L.L.P.

(57) ABSTRACT

A toner including polyester, wherein an amount of heat of a peak derived from the polyester in a range of from 40° C. through 70° C. during a cooling process is from 1.0 J/g through 15 J/g in differential scanning calorimetry performed under conditions below,
<measuring conditions>
after maintaining the toner at −20° C., heating the toner to 130° C. at 10° C./min (a first heating process), after maintaining the toner at 130° C. for 1 minute, cooling the toner to −50° C. at cooling speed of 10° C./min (the cooling process), and after maintaining the toner at −50° C. for 5 minutes, heating the toner to 130° C. at 10° C./min (a second heating process).

10 Claims, 4 Drawing Sheets

(56) References Cited

U.S. PATENT DOCUMENTS

| | | | | |
|---|---|---|---|---|
| 2009/0123864 | A1 | 5/2009 | Sacripante et al. | |
| 2009/0286176 | A1* | 11/2009 | Ohmura ..... | G03G 9/08782 430/107.1 |
| 2014/0363184 | A1 | 12/2014 | Santo et al. | |
| 2015/0037722 | A1 | 2/2015 | Yamazaki et al. | |
| 2015/0253686 | A1* | 9/2015 | Miyakoshi ..... | G03G 9/08755 430/109.4 |
| 2015/0268574 | A1 | 9/2015 | Miyaake et al. | |

FOREIGN PATENT DOCUMENTS

| | | |
|---|---|---|
| JP | 2003-167384 | 6/2003 |
| JP | 2004-240421 A | 8/2004 |
| JP | 2006-293285 | 10/2006 |
| JP | 2007-033773 | 2/2007 |
| JP | 4155108 | 7/2008 |
| JP | 2010-139528 | 6/2010 |

OTHER PUBLICATIONS

Written Opinion dated Oct. 11, 2016 for counterpart International Patent Application No. PCT/JP2016/076042 filed Sep. 5, 2016.
Extended European Search Report dated Jun. 22, 2018 in European Patent Application No. 16859404.2, 6 pages.
Office Action dated Dec. 18, 2018 in corresponding Japanese Patent Application No. 2017-547661, 5 pages.

* cited by examiner

TONER, TONER STORED UNIT, IMAGE FORMING APPARATUS, AND IMAGE FORMING METHOD

CROSS-REFERENCE TO RELATED APPLICATIONS

The present application is a continuation application of International Application No. PCT/JP2016/076042, filed Sep. 5, 2016, which claims priority to Japanese Patent Application No. 2015-213350, filed Oct. 29, 2015. The contents of these applications are incorporated herein by reference in their entirety.

BACKGROUND OF THE INVENTION

Field of the Invention

The present disclosure relates to a toner, a toner stored unit, an image forming apparatus, and an image forming method.

Description of the Related Art

Heretofore, a latent image that is electrically or magnetically formed is visualized with an electrophotographic toner (may be referred to simply as a "toner" hereinafter) in an image forming apparatus of an electrophotographic system etc.

Recently, market demands for high-speed operations and energy saving of image forming apparatuses have been getting strong. There is a need for a toner that has excellent low-temperature fixing ability and can create high-quality images. In order to achieve low-temperature fixing ability of a toner, a softening temperature of a binder resin of the toner needs to be low. When the softening temperature of the binder resin is low, however, so-called offset (also referred to as hot offset hereinafter) tends to occur. The offset is a phenomenon where part of a toner image is deposited on a surface of a fixing member during fixing and the deposited toner is transferred to a copy sheet. Moreover, heat resistant storage properties of the toner deteriorate and so-called blocking where toner particles are fused to each other occurs especially in a high-temperature environment. Also there are problems caused inside the developing device, such as a problem where the toner is fused on the inner area of the developing device or a carrier to contaminate, and a problem where the toner is easily filmed on a surface of a photoconductor.

As a technique to solve the above-described problems, known is use of a crystalline resin as a binder resin of a toner (see, for example, Japanese Patent Nos. 3949553 and 4155108). Since the crystalline resin has properties that a state of the crystalline resin sharply soften at a melting point from a crystalline state, the crystalline resin can significantly reduce a fixing temperature of the toner. Although low-temperature fixing ability of a toner is improved, the toner is soft and easily causes plastic deformation when the crystalline polyester and amorphous polyester are merely blended. Specifically, heat resistant storage properties of the toner become poor, and the toner cannot be supplied because the toner particles are aggregated inside a toner stored container and an image forming apparatus. As a result, the toner density decreases and defective images may be formed. Since it takes a time to recrystallize the crystalline resin inside a toner after the toner is melted on a fixing medium by heat fixing, moreover, hardness of a surface of an image cannot be recovered quickly. As a result, there are problems that scratch marks may be formed on a surface of an image by contact and abrasion with a paper ejection roller or conveying member during a paper ejection step after fixing, and copy sheets are adhered (image adherence resistance) to each other when a large volume is printed.

SUMMARY OF THE INVENTION

According to one aspect of the present disclosure, a toner includes polyester. An amount of heat of a peak derived from the polyester in a range of from 40° C. through 70° C. during a cooling process is from 1.0 J/g through 15 J/g in differential scanning calorimetry performed under conditions below.

<Measuring Conditions>

After maintaining the toner at −20° C., heating the toner to 130° C. at 10° C./min (a first heating process), after maintaining the toner at 130° C. for 1 minute, cooling the toner to −50° C. at cooling speed of 10° C./min (the cooling process), and after maintaining the toner at −50° C. for 5 minutes, heating the toner to 130° C. at 10° C./min (a second heating process).

DESCRIPTION OF THE EMBODIMENTS (Toner)

Figure 1:
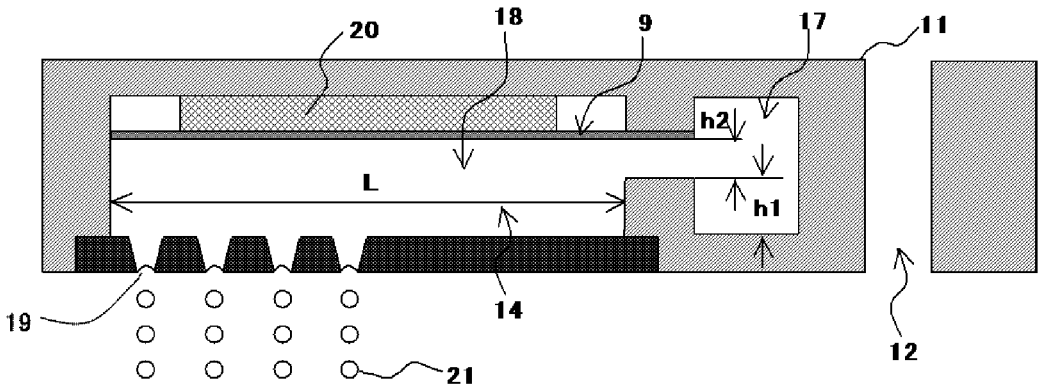
FIG. 1 is a cross-sectional view illustrating one example of a liquid-column-resonance droplet-ejecting unit.

A toner of the present disclosure includes at least polyester and may further include other ingredients according to the necessity, In differential scanning calorimetry (may be referred to as "DSC" hereinafter) performed on the toner under the following measuring conditions, an amount of heat of a peak derived from the polyester in a range of from 40° C. through 70° C. during a cooling process is from 1.0 J/g through 15 J/g.

<Measuring Conditions>

After maintaining the toner at −20° C., heating the toner to 130° C. at 10° C./min (a first heating process), after maintaining the toner at 130° C. for 1 minute, cooling the toner to −50° C. at cooling speed of 10° C./min (the cooling process), and after maintaining the toner at −50° C. for 5 minutes, heating the toner to 130° C. at 10° C./min (a second heating process).

The present disclosure has an object to provide a toner having excellent storage stability and image-adherence resistance, as well as excellent low-temperature fixing ability.

The present disclosure can provide a toner having excellent storage stability and image-adherence resistance, as well as excellent low-temperature fixing ability.

The present inventors have found that crystallization of crystalline polyester is insufficient when the crystalline polyester and amorphous polyester are merely blended and a resultant toner has low heat resistance storage stability and low image strength.

The present inventors have diligently conducted researches based on the above-described insights. As a result, the present inventors have found that storage stability and image strength of a toner that includes a binder resin including crystalline polyester and amorphous polyester largely depend on a crystallization temperature derived from the crystalline polyester in the toner and an amount of heat of the crystallization.

Then, the present inventors have made clear that crystallization of the crystalline polyester can be controlled by appropriately selecting a combination of raw material monomers used for the crystalline polyester and the amorphous polyester, in order to enhance crystallization of the crystalline polyester in the binder resin.

Specifically, the present inventors have accomplished the present disclosure with focusing on elevating a crystallization temperature of the crystalline polyester and increasing the crystallization speed in order to improve storage stability and image strength of a toner.

<Crystallinity of Crystalline Polyester>

In the present specification, the term "crystallization temperature" means a crystallization temperature derived from the crystalline polyester. In the present specification, the term "an amount of heat of crystallization" means an amount of heat of crystallization derived from the crystalline polyester. As described later, the crystallization temperature and the amount of heat of crystallization are determined from a peak during a cooling process in DSC. Therefore, the peak is a peak derived from the crystalline polyester and the crystalline polyester is polyester appearing as the peak in DSC.

A crystallization temperature derived from a crystalline polyester of the toner, an amount of heat of crystallization and a melting point of the toner, and an amount of heat of fusion and a glass transition temperature of the toner can be measured by differential scanning calorimetry (DSC). However, there is a case where it is difficult to distinguish peaks derived from the crystalline polyester from peaks derived from wax contained in a toner depending a type of the toner. Therefore, a crystallization temperature derived from the crystalline polyester, the amount of heat of crystallization and a melting point, and the amount of heat of fusion and a glass transition temperature are preferably calculated after removing the wax component in the toner. A method for removing the wax is preferably preparative HPLC or Soxhlet extraction. Soxhlet extraction is particularly preferable. For example, 1 g of the toner is weighed, the collected toner is placed in cylindrical filter paper No86R and is set in Soxhlet extractor. Soxhlet extraction is performed for 7 hours under reflux using 200 mL of hexane as a solvent. After washing the obtained residue with hexane, the residue is dried under reduced pressure for 24 hours at 40° C., followed by for 24 hours at 60° C., to thereby remove the residual solvent. Subsequently, the resultant is subjected to annealing for from 24 hours through 72 hours in a range of from 40° C. through 60° C. to facilitate crystallization of the crystalline polyester. After maintaining the obtained measuring sample at −20° C., the sample is heated to 130° C. at 10° C./min. After maintaining the sample at 130° C. for 1 minute, the sample is cooled to −50° C. at the cooling speed of 10° C./min. After maintaining the sample at −50° C. for 5 minutes, the sample is further heated to 130° C. at 10° C./min.

The "amount of heat absorbed or released" and "temperature" are plotted to draw a graph. A temperature of an apex of a melting (endothermic) peak obtained in the first heating process (1st heating) is determined as a melting peak temperature (melting point: $Tm_{1st}$), a temperature of an apex of crystallization (exothermic) peak obtained in the cooling process is determined as a crystallization peak temperature, and a temperature of an apex of a melting (endothermic) peak obtained in the second heating process (2nd heating) is determined as a melting peak temperature (melting point: $Tm_{2nd}$). Moreover, an amount of heat of crystallization is calculated by determining release of heat in the range of from 40° C. through 70° C. in the cooling process as a crystallization region. Furthermore, a characteristic curve observed in the first heating process (1st heating) is determined as a glass transition temperature ($Tg_{1st}$), a characteristic curve observed in the second heating process (2nd heating) is determined as a glass transition temperature ($Tg_{2nd}$, and a value obtained from the DSC curve by the midpoint method is used as a glass transition temperature.

The amount of heat of crystallization (an amount of heat of a peak derived from polyester) is calculated from a crystallization onset temperature (a temperature at which a peak curve is clearly away from the base line). The crystallization onset temperature is preferably 40° C. or higher, more preferably 50° C. or higher, and even more preferably 60° C. or higher.

The amount of heat of crystallization derived from the polyester in the toner is from 1.0 J/g through 15 J/g and preferably from 2.5 J/g through 10 J/g. When the amount of heat of crystallization is less than 1.0 J/g, the crystallization degree of the crystalline segment becomes poor. Therefore, reduction in image strength and storage stability occur because a proportion of an amorphous segment increases. When the amount of heat of crystallization is greater than 15 J/g, a proportion of the crystalline segment in the binder resin increases. Therefore, a fixing width becomes narrow due to significant reduction in viscoelasticity in a high temperature region, and strength of an image also reduces.

Specifically, low-temperature fixing ability of the toner is excellent because the toner has an amount of heat of crystallization in the range of from 40° C. through 70° C. in the cooling process in DSC. Moreover, the toner also excels in storage stability and image adherence resistance when the amount of heat of crystallization is from 1.0 J/g through 15 J/g.

The amount of heat of crystallization is a value calculated from an area of the DSC curve in the range of from 40° C. through 70° C., and is preferably a value calculated from an area of the DSC curve in the range of from 50° C. through 70° C.

A temperature of the peak derived from the polyester (crystallization peak temperature) in the cooling process in differential scanning calorimetry is preferably 40° C. or higher, more preferably 45° C. or higher, and particularly preferably 50° C. or higher.

When the crystallization peak temperature is within the above-mentioned preferable range, there is the following advantage of (1).

(1) Since the crystallization degree of the crystalline segment is excellent, image strength tends to be excellent, and as a result image adherence resistance is excellent.

The upper limit of the crystallization peak temperature is not particularly limited and may be appropriately selected depending on the intended purpose. The crystallization peak temperature is preferably 70° C. or lower.

A melting point derived from the crystalline polyester (polyester appearing as the peak) is not particularly limited and may be appropriately selected depending on the intended purpose. The melting point is preferably from 50° C. through 80° C. and more preferably from 60° C. through 70° C.

When the melting point is within the above-mentioned preferable range, there are the following advantages of (1) to (2).

(1) The crystalline polyester does not easily melt at a low temperature and hence storage stability of the toner improves further.

(2) The crystalline polyester is sufficiently melted by heat applied during fixing and hence low-temperature fixing ability improves further.

The toner preferably satisfies Formula (1) below and more preferably satisfies Formula (1-1) below in the differential scanning calorimetry.

$$(Mt_{2nd}/Mt_{1st}) \geq 0.70 \quad \text{Formula (1)}$$

$$(Mt_{2nd}/Mt_{1st}) \geq 0.80 \quad \text{Formula (1-1)}$$

In the formulae above, $Mt_{1st}$ is an amount of heat of fusion (J/g) in the first heating process and $Mt_{2nd}$ is an amount of heat of fusion (J/g) in the second heating process.

When Formula (1) above is satisfied, there is the following advantage of (1).

(1) Since the crystallization degree of the crystalline polyester is excellent, image strength improves further because a proportion of the amorphous segment in the crystalline polyester decreases.

The toner preferably satisfies Formula (2) below and more preferably satisfies Formula (2-1) below in the differential scanning calorimetry.

$$-5° \text{ C.} \leq (Tg_{1st} - Tg_{2nd}) \leq 5° \text{ C.} \quad \text{Formula (2)}$$

$$-3° \text{ C.} \leq (Tg_{1st} - Tg_{2nd}) \leq 3° \text{ C.} \quad \text{Formula (2-1)}$$

In the formulae above, Tgist is a glass transition temperature (° C.) in the first heating process and $Tg_{2nd}$ is a glass transition temperature (° C.) in the second heating process.

When Formula (2) above is satisfied, there is the following advantage of (1).

(1) Since the crystallization degree of the crystalline polyester is excellent, image strength improves further because a proportion of the amorphous segment in the crystalline polyester decreases.

<Binder Resin>

For example, the toner includes a binder resin including the polyester. The toner may further include other ingredients according to the necessity.

The binder resin preferably includes the crystalline polyester and the amorphous polyester. The binder resin may further include other ingredients according to the necessity.

The crystalline polyester is polyester appearing as the above-mentioned peak.

<<Polyester>>

Examples of the polyester include crystalline polyester and amorphous polyester.

<<<Crystalline Polyester>>>

The crystalline polyester is not particularly limited and may be appropriately selected depending on the intended purpose. The crystalline polyester is preferably aliphatic polyester because the aliphatic polyester has excellent sharp-melting properties and high crystallinity.

The aliphatic polyester is obtained through polycondensation between polyvalent alcohol and polyvalent carboxylic acid and/or a polyvalent carboxylic acid derivative, such as polyvalent carboxylic acid, polyvalent carboxylic anhydride, and polyvalent carboxylic acid ester. Preferably, the aliphatic polyester does not include a branch structure. Specifically, the aliphatic polyester includes, as structural components, polyvalent alcohol and polyvalent carboxylic acid and/or a polyvalent carboxylic acid derivative, such as polyvalent carboxylic acid, polyvalent carboxylic anhydride, and polyvalent carboxylic acid ester.

—Polyvalent Alcohol—

The polyvalent alcohol is not particularly limited and may be appropriately selected depending on the intended purpose. Examples of the polyvalent alcohol include diol, and trivalent or higher alcohol.

Examples of the diol include saturated aliphatic diol. Examples of the saturated aliphatic diol include straight-chain saturated aliphatic diol and branched-chain saturated aliphatic diol. Among the above-listed examples, straight-chain saturated aliphatic diol is preferable and straight-chain saturated aliphatic diol having 2 or more but 12 or less carbon atoms is more preferable. When the saturated aliphatic diol is a straight chain type, crystallinity of the crystalline polyester does not lower and a melting point of the crystalline polyester does not become low. When the number of carbon atoms of the saturated aliphatic diol is 12 or less, materials are readily available. Therefore, the number of carbon atoms is more preferably 12 or less.

Examples of the saturated aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecane diol. The above-listed examples may be used alone or in combination.

Among the above-listed examples, ethylene glycol, 1,4-butanediol, 1,6-hexanediol, 1,8-octanediol, 1,10-decanediol, and 1,12-dodecanediol are particularly preferable because the above-listed diols give high crystallinity and excellent sharp-melt properties to the crystalline polyester.

Examples of the trivalent or higher alcohol include glycerin, trimethylol ethane, trimethylol propane, and pentaerythritol. The above-listed examples may be used alone or in combination.

—Polyvalent Carboxylic Acid—

The polyvalent carboxylic acid is not particularly limited and may be appropriately selected depending on the intended purpose. Examples of polyvalent carboxylic acid include divalent carboxylic acid and trivalent or higher carboxylic acid.

Examples of the divalent carboxylic acid include: saturated aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; and aromatic dicarboxylic acid, such as phthalic acid, isophthalic acid, terephthalic acid, naphthalene-2,6-dicarboxylic acid, malonic acid, and mesaconic acid, or anhydrides thereof, or lower (the number of carbon atoms: from 1 through 3) alkyl esters thereof. The above-listed examples may be used alone or in combination.

Examples of the trivalent or higher carboxylic acid include 1,2,4-benzenetricarboxylic acid, 1,2,5-benzenetricarboxylic acid, and 1,2,4-naphthalenetricarboxylic acid, or anhydrides thereof, or lower (the number of carbon atoms: from 1 through 3) alkyl ester thereof. The above-listed examples may be used alone or in combination.

Note that, the polyvalent carboxylic acid may include, other than the saturated aliphatic dicarboxylic acid and the aromatic dicarboxylic acid, dicarboxylic acid including a sulfonic acid group or dicarboxylic acid including a double bond.

The crystalline polyester is preferably obtained through polycondensation between straight-chain saturated aliphatic dicarboxylic acid having 6 or more but 14 or less carbon atoms and straight-chain saturated aliphatic diol having 4 or more but 14 or less carbon atoms. Specifically, the crystalline polyester preferably includes a structural unit derived from saturated aliphatic dicarboxylic acid having 6 or more but 14 or less carbon atoms and a structural unit derived from saturated aliphatic diol having 4 or more but 14 or less carbon atoms.

Moreover, the total number of carbon atoms in the combination of the saturated aliphatic dicarboxylic acid and the saturated aliphatic diol is preferably 16 or more. The combination is preferably a combination of straight-chain aliphatic diol having 4 or more carbon atoms and straight-chain saturated aliphatic dicarboxylic acid having 8 or more carbon atoms. The combination particularly preferably includes straight-chain aliphatic diol having 8 or more carbon atoms or straight-chain saturated aliphatic dicarboxylic acid having 12 or more carbon atoms. Examples of the combination of the straight-chain aliphatic diol and straight-chain saturated aliphatic dicarboxylic acid include a combination of 1,4-butanediol and 1,12-dodecanedicarboxylic acid, a combination of 1,6-hexanediol and 1,12-dodecanedicarboxylic acid, and a combination of 1,10-decanediol and sebacic acid. A resulting crystalline polyester obtained from any of the above-listed combinations has high crystallinity and can exhibit both excellent storage stability of a toner and image durability.

A molecular weight of the crystalline polyester is not particularly limited and may be appropriately selected depending on the intended purpose. As the molecular weight of the crystalline polyester, a weight average molecular weight (Mw) of the crystalline polyester as measured by GPC is preferably from 3,000 through 35,000, more preferably from 10,000 through 35,000, and particularly preferably from 15,000 through 30,000.

When the weight average molecular weight is within the above-mentioned preferable range, there are the following advantages of (1) to (4).

(1) Heat resistant storage properties of the toner improve further.

(2) Durability against stress caused by stirring etc. inside the developing device improved further.

(3) Viscoelasticity of the toner is low when the toner is melted, and low-temperature fixing ability of the toner improves further.

(4) The crystalline segment in the toner is easily crystallized and hence blocking resistance of the toner is excellent.

A melting point (Tm) of the crystalline polyester is not particularly limited and may be appropriately selected depending on the intended purpose. The melting point is preferably from 40° C. through 140° C. and more preferably from 60° C. through 120° C.

When the Tm is within the above-mentioned preferable range, there are the following advantages of (1) to (2).

(1) The toner is not easily melted at a low temperature and hence blocking resistance of the toner is excellent.

(2) The crystalline polyester is sufficiently melted by heat applied during fixing and hence low-temperature fixing ability of the toner improves further.

A crystallization temperature (Tc) of the crystalline polyester is not particularly limited and may be appropriately selected depending on the intended purpose. The crystalline temperature is preferably from 40° C. through 100° C. and more preferably from 50° C. through 80° C.

When the Tc is within the above-mentioned preferable range, there are the following advantages of (1) to (2).

(1) The crystalline polyester is easily crystallized and hence heat resistant storage properties and image strength of the toner improve further.

(2) The crystalline polyester is sufficiently melted by heat applied during fixing and hence low-temperature fixing ability of the toner improves further.

The melting point can be measured from an endothermic peak value of a DSC chart in differential scanning calorimetry (DSC).

An amount of the crystalline polyester in the binder resin is not particularly limited and may be appropriately selected depending on the intended purpose. The amount of the crystalline polyester is preferably from 1% by mass through 20% by mass, more preferably from 3% by mass through 20% by mass, even more preferably from 3% by mass through 15% by mass, and particularly preferably from 5% by mass through 10% by mass, relative to the binder resin.

When the amount of the crystalline polyester is within the above-mentioned preferable range, there are the following advantages of (1) to (2).

(1) Low-temperature fixing ability of the toner improves further.

(2) A glass transition temperature or elasticity recovery temperature of the binder resin is high, and as a result storage stability and image strength improve further.

Crystallinity, a molecular structure, etc. of the crystalline polyester can be confirmed by NMR spectroscopy, differential scanning calorimetry (DSC), X-ray diffraction spectroscopy, GC/MS, LC/MS, or infrared (IR) absorption spectroscopy.

<<Measurement of Amount (% by Mass) of Crystalline Resin by DSC>>

In the present disclosure, an amount of the crystalline resin in the toner can be also determined by DSC.

The crystalline resin includes polyester appearing as the peak.

A ratio measuring method of an amount of the crystalline resin is as follows.

A total amount of the crystalline resin in the toner particles is obtained by differential scanning calorimetry (DSC). A toner sample and a single crystalline resin sample are each measured by the following measuring device and conditions. From a ratio between the obtained amount of heat absorbed in the crystalline resin of the toner sample and the obtained amount of heat absorbed in the crystalline resin of the single crystalline resin sample, an amount of the crystalline resin in the toner is determined.

Measuring device: DSC (DSC60, available from Shimadzu Corporation)

Amount of sample: about 5 mg

Heating temperature: 10° C./min

Measurement range: from room temperature through 150° C.

Measuring environment: in nitrogen gas atmosphere

A total amount of the crystalline resin is calculated by Formula 1 below.

Total amount of crystalline resin (% by mass)= (amount of heat (J/g) absorbed in crystalline resin of toner sample)×100)/(amount of heat (J/g) absorbed in single crystalline resin) (Formula 1)

The amount of the crystalline resin in the toner determined by DSC is preferably 1% by mass or greater but 20% by mass or less relative to the toner including the crystalline resin. When the amount of the crystalline resin is 1% by mass or greater relative to the toner, a problem that an effect of low-temperature fixing ability cannot be exhibited can be prevented. When the amount of the crystalline resin is 20% by mass or less relative to the toner, a problem that heat resistant storage properties or paper ejection blocking resistance is deteriorated can be prevented.

<<<Amorphous Polyester>>>

The amorphous polyester is obtained using a polyvalent alcohol component and a polyvalent carboxylic acid component, such as polyvalent carboxylic acid, polyvalent carboxylic anhydride, and polyvalent carboxylic acid ester. Specifically, the amorphous polyester includes, as structural components, a polyvalent alcohol component and a polyvalent carboxylic acid component, such as polyvalent carboxylic acid, polyvalent carboxylic anhydride, and polyvalent carboxylic acid ester.

—Polyvalent Alcohol Component—

Examples of the polyvalent alcohol component include divalent alcohol (diol). Specific examples include: alkylene glycol having from 2 through 36 carbon atoms (e.g., ethylene glycol, 1,2-propyleneglycol, 1,3-propyleneglycol, 1,4-butyleneglycol, and 1,6-hexanediol); alkylene ether glycol having from 4 through 36 carbon atoms (e.g., diethylene glycol, triethylene glycol, dipropylene glycol, polyethylene glycol, polypropylene glycol, and polybutylene glycol); alicyclic diol having from 6 through 36 carbon atoms (e.g., 1,4-cyclohexane dimethanol, and hydrogenated bisphenol A); adducts (the number of moles added: from 1 through 30) of the alicyclic diol with alkylene oxide having from 2 through 4 carbon atoms [e.g., ethylene oxide (abbreviated as "EO" hereinafter), propylene oxide (abbreviated as "PO" hereinafter), and butylene oxide (abbreviated as "BO" hereinafter)]; and adducts (the number of moles added: from 2 through 30) of bisphenols (e.g., bisphenol A, bisphenol F, and bisphenol 5) with alkylene oxide having from 2 through 4 carbon atoms (e.g., EO, PO, and BO).

In addition to the divalent diol, moreover, a trivalent or higher (trivalent through octavalent, or higher) alcohol component may be included. Specific examples of the trivalent or higher alcohol component include: trivalent through octavalent or higher aliphatic polyvalent alcohol having from 3 through 36 carbon atoms (alkane polyol and intramolecular or intermolecular dehydration products, such as glycerin, triethylol ethane, trimethylol propane, pentaerythritol, sorbitol, sorbitan, polyglycerin, and dipentaerythritol; sugars and derivatives of sugars, such as sucrose and methyl glucoside); adducts (the number of moles added: from 1 through 30) of the aliphatic polyvalent alcohol with alkylene oxide having from 2 through 4 carbon atoms (e.g., EO, PO, and BO); adducts (the number of moles added: from 2 through 30) of trisphenols (e.g., trisphenol PA) with alkylene oxide having from 2 through 4 carbon atoms (e.g., EO, PO, and BO); and adducts (the number of moles added: from 2 through 30) of novolak resins (e.g., phenol novolak and cresol novolak, the average degree of polymerization: from 3 through 60) with alkylene oxide having from 2 through 4 carbon atoms (e.g., EO, PO, and BO). The above-listed examples may be used alone or in combination.

—Polyvalent Carboxylic Acid Component—

Examples of the polyvalent carboxylic acid component include divalent carboxylic acid (dicarboxylic acid). Specific examples include: alkane dicarboxylic acid having from 4 through 36 carbon atoms (e.g., succinic acid, adipic acid, and sebacic acid) and alkenyl succinic acid (e.g., dodecenyl succinic acid); alicyclic dicarboxylic acid having from 4 through 36 carbon atoms [e.g., dimer acid (dimerized linoleic acid)]; alkene dicarboxylic acid having from 4 through 36 carbon atoms (e.g., maleic acid, fumaric acid, citraconic acid, and mesaconic acid); and aromatic dicarboxylic acid having from 8 through 36 carbon atoms (e.g., phthalic acid, isophthalic acid, terephthalic acid, or derivatives thereof, and naphthalene dicarboxylic acid). Among them, alkane dicarboxylic acid having from 4 through 20 carbon atoms and aromatic dicarboxylic acid having from 8 through 20 carbon atoms are preferable. Note that, as the polyvalent carboxylic acid component, acid anhydrides or lower alkyl (the number of carbon atoms: from 1 through 4) ester (e.g., methyl ester, ethyl ester, and isopropyl ester) of the above-listed examples are also included. The above-listed examples may be used alone or in combination.

Other than the examples listed above, ring-opening polymerized polymers, such as polylactic acid or polycarbonate diol can be suitably used.

A molecular weight of the amorphous polyester is not particularly limited and may be appropriately selected depending on the intended purpose. As the molecular weight of the amorphous polyester, a weight average molecular weight (Mw) of the amorphous polyester as measured by GPC is preferably from 5,000 through 35,000, more preferably from 10,000 through 35,000, and particularly preferably from 13,000 through 25,000.

A glass transition temperature (Tg) of the amorphous polyester is not particularly limited and may be appropriately selected depending on the intended purpose. The glass transition temperature (Tg) is preferably from 50° C. through 80° C.

When the Tg is within the above-mentioned preferable range, there are the following advantages of (1) to (3).

(1) Heat resistant storage properties of the toner improve further.

(2) Durability of the toner against stress caused by stirring etc. in the developing device improves further.

(3) Viscoelasticity of the toner is low when the toner is melted and hence low-temperature fixing ability improves further.

A softening temperature of the amorphous polyester is not particularly limited and may be appropriately selected depending on the intended purpose. The softening temperature is preferably from 130° C. through 180° C.

A molecular structure of the amorphous polyester can be confirmed by GC/MS, LC/MS, and IR spectroscopy as well as liquid or solid NMR.

<Other Ingredients>

The above-mentioned other ingredients are not particularly limited and may be appropriately selected depending on the intended purpose. Examples of the other ingredients include a colorant, a release agent, a charge-controlling agent, and a fluidizing agent.

<<Colorant>>

The colorant is not particularly limited and may be appropriately selected depending on the intended purpose. Examples of the colorant include carbon black, iron black, Sudan Black SM, fast yellow G, benzidine yellow, solvent yellow (21, 77, 114 etc.), pigment yellow (12, 14, 17, 83 etc.), Indofast Orange, irgasine red, paranitroaniline red, toluidine red, solvent red (17, 49, 128, 5, 13, 22, 48·2 etc.), disperse red, Carmine FB, pigment orange R, Lake Red 2G, Rhodamine FB, Rhodamine B Lake, methyl violet B lake, phthalocyanine blue, solvent blue (25, 94, 60, 15·3 etc.), pigment blue, brilliant green, phthalocyanine green, Oil Yellow GG, Kayaset YG, Orasol Brown B, and Oil Pink OP. The above-listed examples may be used alone or in combination.

An amount of the colorant is not particularly limited and may be appropriately selected depending on the intended purpose. The amount of the colorant is preferably from 0.1 parts by mass through 40 parts by mass and more preferably from 0.5 parts by mass through 10 parts by mass, relative to 100 parts by mass of the binder resin.

<<Release Agent>>

The release agent is not particularly limited and may be appropriately selected depending on the intended purpose. Examples of the release agent include polyolefin wax, natural wax (e.g., carnauba wax, montan wax, paraffin wax, and rice bran wax), aliphatic alcohol having from 30 through 50 carbon atoms (e.g., triacontanol), fatty acid having from 30 through 50 carbon atoms (e.g., triacontane carboxylic acid), and mixtures thereof.

Examples of the polyolefin wax include the following wax.

- (Co)polymer [including those obtained by (co)polymerization and thermally degraded polyolefin] of olefin (e.g., ethylene, propylene, 1-butene, isobutylene, 1-hexene, 1-dodecene, 1-octadecene, and mixtures thereof)
- Oxides of (co)polymer of olefin with oxygen and/or ozone
- Maleic acid modified products [e.g., modified products of maleic acid and maleic acid derivatives (e.g., maleic anhydride, monomethyl maleate, monobutyl maleate, and dimethyl maleate)] of (co)polymer of olefin
- Copolymer of olefin and unsaturated carboxylic acid [e.g., (meth)acrylic acid, itaconic acid, and maleic anhydride] and/or unsaturated alkyl carboxylic acid ester [e.g., alkyl (meth)acrylate (the number of carbon atoms of alkyl: from 1 through 18) and alkyl maleate (the number of carbon atoms of alkyl: from 1 through 18)]
- Polymethylene (e.g., Fischer-Tropsch Wax, such as Sasol wax)
- Fatty acid metal salt (e.g., calcium stearate)
- Fatty acid ester (e.g., behenyl behenate)

A softening temperature of the release agent is not particularly limited and may be appropriately selected depending on the intended purpose. The softening temperature is preferably from 50° C. through 170° C.

An amount of the release agent is not particularly limited and may be appropriately selected depending on the intended purpose.

<<Charge-controlling Agent>>

The charge-controlling agent is not particularly limited and may be appropriately selected depending on the intended purpose. Examples of the charge-controlling agent include nigrosine dyes, triphenylmethane-based dyes including tertiary amine as a side chain, quaternary ammonium salts, polyamine resins, imidazole derivatives, polymers including a quaternary ammonium salt group, metal-containing azo dyes, copper phthalocyanine dyes, salicylic acid metal salts, boron complexes of benzyl acid, sulfonic acid group-containing polymers, fluorine-containing polymers, halogen-substituted aromatic ring-containing polymers, metal complexes of alkyl derivatives of salicylic acid, and cetyl trimethyl ammonium bromide.

An amount of the charge-controlling agent is not particularly limited and may be appropriately selected depending on the intended purpose.

<<Fluidizing Agent>>

The fluidizing agent is not particularly limited and may be appropriately selected depending on the intended purpose. Examples of the fluidizing agent include colloidal silica, alumina powder, titanium oxide powder, calcium carbonate powder, barium titanate, magnesium titanate, calcium titanate, strontium titanate, zinc oxide, silica sand, clay, mica, wollastonite, diatomaceous earth, chromium oxide, cerium oxide, red iron oxide, antimony trioxide, magnesium oxide, zirconium oxide, barium sulfate, and barium carbonate.

An amount of the fluidizing agent is not particularly limited and may be appropriately selected depending on the intended purpose.

A compositional ratio of the toner is not particularly limited and may be appropriately selected depending on the intended purpose.

An amount of the binder resin in the toner is preferably from 30% by mass through 97% by mass, more preferably from 40% by mass through 95% by mass, and particularly preferably from 45% by mass through 92% by mass.

An amount of the colorant in the toner is preferably from 0.05% by mass through 60% by mass, more preferably from 0.1% by mass through 55% by mass, and particularly preferably from 0.5% by mass through 50% by mass.

An amount of the release agent in the toner is preferably from 0% by mass through 30% by mass, more preferably from 0.5% by mass through 20% by mass, and particularly preferably from 1% by mass through 10% by mass.

An amount of the charge-controlling agent in the toner is preferably from 0% by mass through 20% by mass, more preferably from 0.1% by mass through 10% by mass, and particularly preferably from 0.5% by mass through 7.5% by mass.

An amount of the fluidizing agent in the toner is preferably from 0% by mass through 10% by mass, more preferably from 0% by mass through 5% by mass, and particularly preferably from 0.1% by mass through 4% by mass.

<Toner Production Method>

A production method of a toner associated with the present disclosure includes at least a droplet-forming step and a droplet-solidifying step. The production method may further include other steps according to the necessity.

In order to obtain the toner of the present disclosure having the above-mentioned properties, the toner can be produced by a toner production method including a droplet-forming step including ejecting a toner composition liquid, in which a binder resin and a release agent are dissolved or dispersed in an organic solvent, to thereby form droplets, and a droplet-solidifying step including solidifying the droplets to thereby form toner particles.

<<Droplet-forming Step>>

The droplet-forming step is a step including ejecting a toner composition liquid, in which a binder resin and a release agent are dissolved or dispersed in an organic solvent, to thereby from droplets.

For example, the toner composition liquid can be obtained by dissolving or dispersing, in an organic solvent, a toner composition that includes at least the binder resin and the release agent and may further include other ingredients according to the necessity.

The organic solvent is not particularly limited as long as the organic solvent is a volatile organic solvent capable of dissolving or dispersing a toner composition in the toner composition liquid, and may be appropriately selected depending on the intended purpose.

Note that, it is possible to heat the organic solvent and the toner composition liquid to dissolve the release agent. In order to achieve stable continuous ejection, however, a temperature of the toner composition liquid in the environmental temperature of the droplet-solidifying step is preferably less than [Tb−20]° C. where Tb (° C.) is a boiling point of the organic solvent.

When the temperature of the toner composition liquid is less than [Tb−20]° C., problems, such as generation of bubbles inside a toner composition liquid chamber due to evaporation of the organic solvent, and reduction in size of an ejection hole due to drying the toner composition liquid near the ejection hole, do not occur and stable ejection can be performed.

In order to prevent blockage of the ejection hole, the release agent needs to be dissolved in the toner composition liquid. In order to obtain uniform toner particles, it is important that the release agent is dissolved without causing phase separation with the binder resin dissolved in the toner composition liquid. In order to prevent offset during fixing with exhibiting release properties, moreover, it is important that the binder resin and the release agent form phase separation in the toner particles from which the organic solvent has been removed. When the release agent does not form a phase separation with the binder resin, not only that the release agent cannot exhibit release properties, but also that viscosity or elasticity of the toner is low as the binder resin is melted binder resin and hence hot offset tends to occur.

Accordingly, the most suitable release agent may be selected depending on the organic solvent or binder resin for use.

<<Organic Solvent>>

The organic solvent is not particularly limited as long as the organic solvent is a volatile organic solvent that can dissolve or disperse the toner composition and may be appropriately selected depending on the intended purpose. For example, solvents, such as ethers, ketones, esters, hydrocarbons, and alcohols are preferably used. Particularly preferable are tetrahydrofuran (THF), acetone, methyl ethyl ketone (MEK), ethyl acetate, toluene, and water. The above-listed examples may be used alone or in combination.

<<Preparation Method of Toner Composition Liquid>>

A toner composition liquid can be obtained by dissolving or dispersing the toner composition in an organic solvent.

In order to prevent clogging of an ejection hole, it is important in the preparation of the toner composition liquid that dispersed elements, such as a colorant are sufficiently finely dispersed relative to an opening diameter of a nozzle by means of a homomixer or a bead mill.

A solid content of the toner composition liquid is preferably from 3% by mass through 40% by mass. When the solid content is within the above-mentioned preferable range, there are the following advantages of (1) to (3).

(1) Reduction in productivity can be prevented.

(2) Problems that "dispersed elements, such as a colorant, tend to be precipitated or aggregated, a composition per toner particle tends to be uneven, and a quality of the toner lowers" can be prevented.

(3) The toner of small particle diameter can be obtained.

For example, the step for ejecting the toner composition liquid to form droplets can be performed by ejecting droplets using a droplet-ejecting unit.

<<Droplet-ejecting Unit>>

The droplet-ejecting unit is not particularly limited as long as the droplet-ejecting unit gives a narrow particle diameter distribution of droplets ejected. The droplet-ejecting unit may be appropriately selected from units known in the art according to the intended purpose. Examples of the droplet-ejecting unit include 1-fluid nozzles, 2-fluid nozzles, membrane-vibration ejecting units, Rayleigh-breakup ejecting units, liquid-vibration ejecting units, and liquid-column-resonance ejecting units.

Examples of the membrane-vibration ejecting unit include ejecting units disclosed in Japanese Unexamined Patent Application Publication No. 2008-292976.

Examples of the Rayleigh-breakup ejecting unit include ejecting units disclosed in Japanese Patent No. 4647506.

Examples of the liquid-vibration ejecting unit include ejecting units disclosed in Japanese Unexamined Patent Application Publication No. 2010-102195.

Examples of the liquid-column-resonance ejecting unit include ejecting units disclosed in Japanese Unexamined Patent Application Publication No. 2011-212668.

In order to make a particle diameter distribution of droplets narrow and assure productivity of the toner, droplet formation through liquid column resonance using the liquid-column-resonance ejecting unit can be utilized. In the droplet formation through liquid column resonance, vibrations were applied to a liquid in a liquid-column-resonance liquid chamber to form standing waves due to liquid column resonance, and the liquid may be ejected from a plurality of ejection holes formed in the regions that were the bellies of the standing waves.

FIG. 1 is a cross-sectional view illustrating a structure of the liquid-column-resonance droplet-ejecting unit.

The liquid-column-resonance droplet-ejecting unit 11 illustrated in FIG. 1 includes a liquid common supply channel 17 and a liquid-column-resonance liquid chamber 18. The liquid-column-resonance liquid chamber 18 is communicated with the liquid common supply channel 17 formed in one wall surface among wall surfaces of the both edges in the longitudinal direction. Moreover, the liquid-column-resonance liquid chamber 18 has ejection holes 19 that are formed in one wall surface amount wall surfaces connected to the wall surfaces of the both edges and are configured to eject droplets 21, and a vibration-generating unit 20 that is formed in a wall surface facing to the ejection holes 19 and is configured to generate high frequency vibrations for forming liquid column resonance standing waves. Note that, a high frequency power supply that is not illustrated is coupled with vibration-generating unit 20.

A toner composition liquid in which a toner composition is dissolved or dispersed in a volatile organic solvent (simply referred to as the "toner composition" hereinafter) 14 is flown into the liquid common supply channel 17 via a liquid supply tube by a liquid circulation pump that is not illustrated. Then, the toner composition liquid is supplied to the liquid-column-resonance liquid chamber 18 of the liquid-column-resonance droplet-ejecting unit 11 illustrated in FIG. 1. Inside the liquid-column-resonance liquid chamber 18 charged with the toner composition liquid 14, a pressure distribution is formed by liquid column resonance standing waves generated by the vibration-generating 20. Then, droplets 21 are ejected from the ejection holes 19 disposed in the regions that are bellies of the standing waves that are areas having large amplitudes in the liquid column resonance standing waves and large pressure variations. The regions that are bellies of the standing waves of liquid column resonance mean the regions other than sections of the standing waves. The regions are preferably regions that have amplitudes with which the pressure variations of the standing waves are large enough to eject the liquid. The regions are more preferably regions that are ±¼ a wavelength from the portions at which the amplitudes of the pressure standing waves become maximum (sections as speed standing waves) towards the positions at which the amplitudes become minimum. As long as the location is in the regions that are bellies of the standing waves, substantially uniform droplets can be formed from ejection holes, even when a plurality of the ejection holes are disposed, and moreover ejection of droplets can be performed efficiently, and therefore clogging of the ejection holes are not easily caused. Note that, the toner composition liquid 14 passed through the liquid common supply channel 17 is returned back to a raw material container via a liquid return tube that is not illustrated. When an amount of the toner composition liquid 14 inside the liquid-column-resonance liquid chamber 18 is reduced by ejection of the droplets 21, a suction force due to the actions of the liquid column resonance standing waves inside the liquid-column-resonance liquid chamber 18 is worked to increase a flow rate of the toner composition liquid 14 supplied from the liquid common supply channel 17 to thereby supply the toner composition liquid 14 into the liquid-column-resonance liquid chamber 18. When the toner composition liquid 14 is supplied into the liquid-column-resonance liquid chamber 18, the flow rate of the toner composition liquid 14 passing through the liquid common supply channel 17 is returned back to the original flow rate.

The liquid-column-resonance liquid chamber 18 of the liquid-column-resonance droplet-ejecting unit 11 is formed by joining frames together. The frames are formed of a material having rigidity high enough not to affect resonance frequency of the liquid with driving frequency. Such a material includes metals, ceramics, and silicon. As illustrated in FIG. 1, moreover, a length L between the wall surfaces of the both edges of the liquid-column-resonance liquid chamber 18 in the longitudinal direction is determined based on the principle of liquid column resonance.

<Droplet-solidifying Step>

The droplet-solidifying step is a step including solidifying the droplets to form a toner. Specifically, a process for solidifying droplets of the toner composition liquid ejected into air from the droplet-ejecting unit is performed, followed by performing a process for collecting the solidified droplets, to thereby obtain the toner of the present disclosure.

The droplet-solidifying unit is a unit configured to solidify the droplets to form a toner.

<<Droplet-solidifying Unit>>

Solidification of the droplets is not particularly limited as long as the toner composition liquid can be turned into a solid state and may be appropriately selected depending on characteristics of the toner composition liquid. When the toner composition liquid is a liquid in which solid raw materials are dissolved or dispersed in a volatile solvent, for example, solidification can be achieved by, after jetting droplets, drying the droplets in transporting air flow, i.e., evaporating the solvent. In the course of drying the solvent, a drying state can be adjusted by appropriately selecting a temperature or vapor pressure of a gas jetted or a type of gas. Moreover, the solidified particles may not be completely dried as long as the collected particles can maintain a solid state, and the particles may be additionally dried in a separate step after collection. Moreover, a solidified state may be realized by a temperature change or a chemical reaction.

<<<Solidified-particles Collecting Unit>>>

The solidified particles can be collected from the gas by powder collection unit known in the art, such as cyclone collection and back filter.

Figure 2:
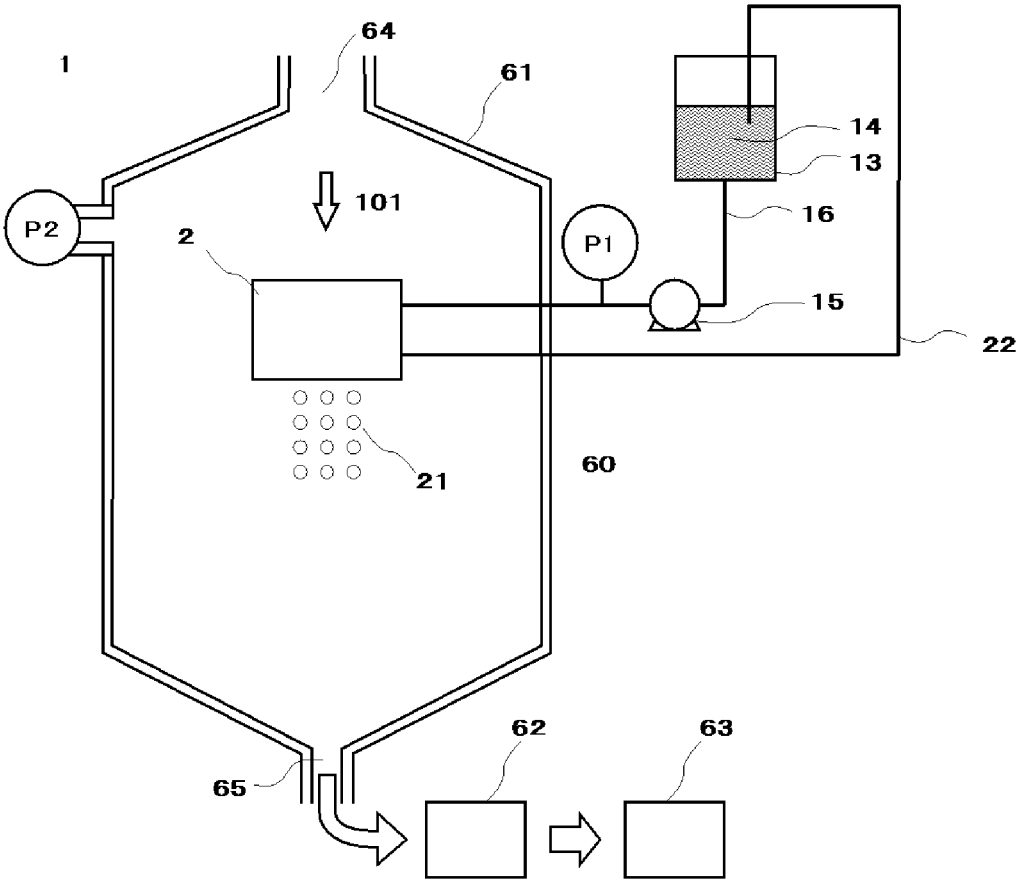
FIG. 2 is a cross-sectional view illustrating one example of an apparatus for performing a production method of a toner.

FIG. 2 is a cross-sectional view illustrating one example of a device for performing the production method of the toner of the present disclosure. A toner production device 1 includes a, droplet-ejecting unit 2 and a drying and collecting unit 60.

With the droplet-ejecting unit 2, a raw material stored container 13 configured to store the toner composition liquid 14, and a liquid circulation pump 15 are connected. The liquid circulation pump 15 is configured to supply the toner composition liquid stored in the raw material stored container 13 to the droplet-ejecting unit 2 via the liquid supply tube 16, and to pump the toner composition liquid 14 inside the liquid supply tube to return the toner composition liquid 14 to the raw material stored container 13 via the liquid return tube 22. In this manner, the toner composition liquid 14 can be supplied to the droplet-ejecting unit 2 at any time. A pressure gauge P1 is disposed to the liquid supply tube 16 and a pressure gauge P2 is disposed to the drying and collecting unit. The liquid-feeding pressure to the droplet-ejecting unit 2 and the pressure inside the drying and collecting unit are managed by the pressure gauges P1 and P2. When the pressure satisfies the relationship of P1>P2, the toner composition liquid 14 may be oozed out from the ejection holes 19. When the pressure satisfies the relationship of P1<P2, gas enters the ejecting unit and ejection may be stopped. Therefore, the relationship of the pressure is preferably P1≈P2.

Inside the chamber 61, downdraft (transporting air flow) 101 started from the transporting air flow inlet 64 is formed. The droplets 21 ejected from the droplet-ejecting unit 2 are transported downwards by the transporting air flow 101 not by gravity, are discharged from the transporting air flow outlet 65, are collected by the solidified-particles collecting unit 62, and then are stored in a solidified-particle storing unit 63.

—Transporting Air Flow—

Regarding the transporting air flow, attention may be paid on the following points.

When jetted droplets are brought into contact with each other before being dried, the droplets are merged into one particle (this phenomenon may be referred to as "coalescence" hereinafter). In order to obtain solid particles having a uniform particle diameter distribution, a distance between jetted droplets needs to be maintained. The jetted droplets have a certain initial speed for traveling, but the traveling speed eventually decreases due to air resistance. Droplets jetted later may catch up with the particles traveling at the decreased speed and as a result, coalescence occurs. Since this phenomenon occurs regularly, a particle diameter distribution of resultant particles is poor when the fused particles are collected. In order to prevent coalescence, reduction in the speed of the droplets needs to be prevented and the droplets needs to be transported with solidifying while coalescence is prevented by the transporting air flow 101 not to bring the droplets into contact with each other. Eventually, the solidified particles are transported to the solidified-particles collecting unit 62.

Figure 3:
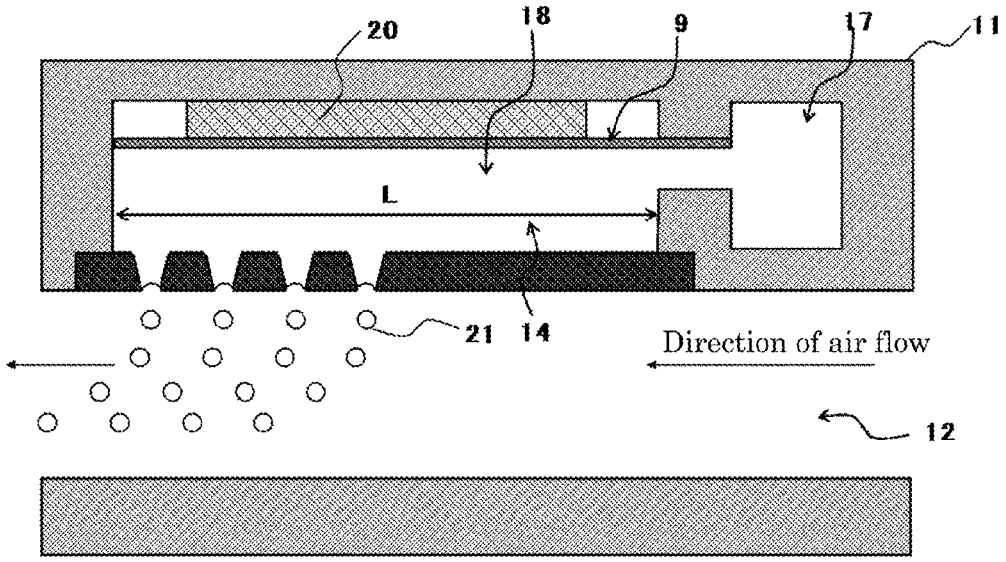
FIG. 3 is a cross-sectional view illustrating another example of a liquid-column-resonance droplet-ejecting unit.

As illustrated in FIG. 1, for example, part of the transporting air flow 101 is arranged near the droplet-ejecting direction to be an identical direction to the droplet-ejecting direction by an air flow channel 12, and therefore reduction in the speed of the droplets just after ejection of the droplets can be prevented and coalescence can be prevented. Alternatively, the direction of the transporting air flow may be the cross direction relative to the ejecting direction as illustrated in FIG. 3. Although it is not illustrated, the direction of the transporting air flow may be angled. The direction of the transporting air flow is preferably angled in a manner that droplets come away from the droplet-ejecting unit. In the case where the coalescence-prevention air flow is provided from the cross direction relative to the ejection of droplets as illustrated in FIG. 3, the direction of the air flow is preferably the direction in which trajectories are not overlapped when the droplets are transported from the ejection holes from the coalescence-prevention air flow.

After preventing coalescence by the first air flow as described above, solidified particles may be transported to the solidified-particle collecting unit by a second air flow.

The speed of the first air flow is preferably identical or faster than the speed for jetting droplets. When the speed of the coalescence-prevention air flow is slower than the speed for jetting droplets, it is difficult to exhibit the function of preventing contact between droplet particles, which is original object of the coalescence-prevention air flow.

As properties of the first air flow, conditions under which coalescence of droplets do not occur can be added. The properties of the first air flow may not be identical to properties of the second air flow. Moreover, a chemical substance that accelerate solidification of surfaces of particles may be mixed into the coalescence-prevention air flow, or the coalescence-prevention air flow may be provided with a physical effect.

The transporting air flow 101 is not particularly limited in terms of a state of the air flow. The transporting air flow 101 may be laminar flow, swirling flow, or turbulence. A type of gas constituting the transporting air flow 101 is not particularly limited. Air or incombustible gas, such as nitrogen, may be used. Moreover, a temperature of the transporting air flow 101 can be appropriately adjusted. Preferably, the temperature does not change during production. Moreover, a unit configured to change the air flow state of the transporting air flow 101 may be disposed in the chamber 61. The transporting air flow 101 may be used for not only preventing coalescence of the droplets 21 but also preventing deposition of the droplets to the chamber 61.

—Secondary Drying—

The production method of the toner of the present disclosure may further include a secondary drying step.

When an amount of the residual solvent contained in the toner particles obtained by the solidified-particle collecting unit 62 illustrated in FIG. 2 is large, for example, secondary drying is optionally performed in order to reduce the amount of the residual solvent.

The secondary drying is not particularly limited. The secondary drying can be performed by means of a typical drying unit known in the art, such as fluidized-bed drying and vacuum drying.

(Developer)

A developer associated with the present disclosure includes at least the toner of the present disclosure. The developer may further include other ingredients, such as a carrier, according to the necessity.

<Carrier>

The carrier is not particularly limited and may be appropriately selected depending on the intended purpose. Examples of the carrier include a carrier of ferrite, magnetite, etc., and a resin-coated carrier.

The resin-coated carrier includes carrier core particles, and a resin coating material that is a resin covering (coating) surfaces of the carrier core particles.

A volume resistance value of the carrier is not particularly limited and may be set by appropriately adjusting according to surface irregularities of the carrier and an amount of the resin coated. The volume resistance value is preferably from $10^6$ log (Ω·cm) through $10^{10}$ log (Ω·cm).

An average particle diameter of the carrier is not particularly limited and may be appropriately selected depending on the intended purpose. The average particle diameter is preferably from 4 μm through 200 μm.

(Toner Stored Unit)

A toner stored unit of the present disclosure is a unit that has a function of storing a toner and stores the toner. Examples of embodiments of the toner stored unit include a toner stored container, a developing device, and a process cartridge.

The toner stored container is a container in which a toner is stored.

The developing device is a device including a unit configured to store a toner and develop.

The process cartridge is a process cartridge which includes at least an image bearer and a developing unit that are integrated, stores a toner, and is detachably mounted in an image forming apparatus. The process cartridge may further includes at least one selected from the group consisting of a charging unit, an exposing unit, and a cleaning unit.

When an image is formed by mounting the toner stored unit of the present disclosure in an image forming apparatus, image formation is performed using the toner of the present disclosure. Therefore, the toner stored unit including a toner having excellent storage stability and image adherence resistance as well as excellent low-temperature fixing ability is obtained.

(Image Forming Apparatus and Image Forming Method)

An image forming apparatus of the present disclosure includes at least an electrostatic latent image bearer (may be referred to as a "photoconductor" hereinafter), an electrostatic latent image forming unit, and a developing unit. The image forming apparatus may further include other units according to the necessity.

An image forming method associated with the present disclosure includes at least an electrostatic latent image forming step and a developing step. The image forming method may further include other steps according to the necessity.

The image forming method is suitably performed by the image forming apparatus. The electrostatic latent image forming step is suitably performed by the electrostatic latent image forming unit. The developing step is suitably performed by the developing unit. The above-mentioned other steps are suitably performed by the above-mentioned other units.

<Electrostatic Latent Image Bearer>

A material, structure, and size of the electrostatic latent image bearer are not particularly limited and can be appropriately selected from materials, structures, and sizes known in the art. Examples of the material include: inorganic photoconductors, such as amorphous silicon and selenium; and organic photoconductors, such as polysilane, and phthalopolymethine. Among the above-listed examples, amorphous silicon is preferable in view of a long service life.

A shape of the electrostatic latent image bearer is not particularly limited and may be appropriately selected depending on the intended purpose. The shape of the electrostatic latent image bearer is preferably a cylinder. An outer diameter of the cylindrical electrostatic latent image bearer is not particularly limited and may be appropriately selected depending on the intended purpose. The outer diameter is preferably from 3 mm through 100 mm, more preferably from 5 mm through 50 mm, and particularly preferably from 10 mm through 30 mm.

<Electrostatic Latent Image Forming Unit and Electrostatic Latent Image Forming Step>

The electrostatic latent image forming unit is not particularly limited as long as the electrostatic latent image forming unit is a unit configured to form an electrostatic latent image on the electrostatic latent image bearer and may be appropriately selected depending on the intended purpose. Examples of the electrostatic latent image forming unit include a unit including at least a charging member configured to charge a surface of the electrostatic latent image bearer and an exposing member configured to expose the surface of the electrostatic latent image bearer to light imagewise.

The electrostatic latent image forming step is not particularly limited as long as the electrostatic latent image forming step is a step including forming an electrostatic latent image on the electrostatic latent image bearer and may be appropriately selected depending on the intended purpose. For example, the electrostatic latent image forming step can be performed by charging a surface of the electrostatic latent image bearer followed by exposing the surface to light imagewise, and the electrostatic latent image forming step can be performed by means of the electrostatic latent image forming unit.

<<Charging Member and Charging>>

The charging member is not particularly limited and may be appropriately selected depending on the intended purpose. Examples of the charging member include conventional contact chargers, equipped with a conductive or semiconductive roller, brush, film, or rubber blade, and non-contact chargers utilizing corona discharge, such as corotron, and scorotron.

For example, the charging can be performed by applying voltage to a surface of the electrostatic latent image bearer using the charging member.

<<Exposing Member and Exposing>>

The exposing member is not particularly limited as long as the exposing member is capable of exposing the charged surface of the electrostatic latent image bearer by the charging member to light in a shape of an image to be formed and may be appropriately selected depending on the intended purpose. Examples of the exposing member is various exposing members, such as a copy optical exposing member, a rod lens array exposing member, a laser optical exposing member, and a liquid crystal shutter optical exposing member.

For example, the exposure can be performed by exposing the surface of the electrostatic latent image bearer to light imagewise using the exposing member.

Note that, in the present disclosure, a back-exposure system may be employed. The back-exposure system is a system where the photoconductor is exposed to light imagewise from the back side of the photoconductor.

<Developing Unit and Developing Step>

The developing unit is not particularly limited as long as the developing unit is a developing unit that is configured to develop the electrostatic latent image formed on the electrostatic latent image bearer to form a visible image and stores a toner. The developing unit may be appropriately selected depending on the intended purpose.

The developing step is not particularly limited as long as the developing step is a step including developing the electrostatic latent image formed on the electrostatic latent image bearer with a toner to form a visible image. The developing step may be appropriately selected depending on the intended purpose. For example, the developing step can be performed by the developing unit.

The developing unit may be a developing unit of a dry-developing system or a developing unit of a wet-developing system. Moreover, the developing unit may be a developing unit for a single color or a developing unit for multiple colors.

The developing unit is preferably a developing device including a stirrer and a developer bearer. The stirrer is configured to stir the toner to cause friction and to thereby charge the toner. The developer bearer includes a magnetic field-generating unit fixed inside the developer bearer, and is configured to bear a developer including the toner on a surface of the developer bearer with rotating.

<Other Units and Other Steps>

Examples of the above-mentioned other units include a transferring unit, a fixing unit, a cleaning unit, a charge-eliminating unit, a recycling unit, and a controlling unit.

Examples of the above-mentioned other steps include a transferring step, a fixing step, a cleaning step, a charge-eliminating step, a recycling step, and a controlling step.

<<Transferring Unit and Transferring Step>>

The transferring unit is not particularly limited as long as the transferring unit is a unit configured to transfer the visible image to a recording medium. The transferring unit may be appropriately selected depending on the intended purpose. A preferable embodiment of the transferring unit includes a primary transferring unit configured to transfer visible images onto an intermediate transfer member to form a composite transfer image and a secondary transfer unit configured to transfer the composite transfer image to a recording medium.

Note that, the recording medium is typically plain paper. However, the recording medium is not particularly limited as long as the recording medium is a recording medium to which an unfixed image after developing can be transferred. The recording medium may be appropriately selected depending on the intended purpose. A PET base for OHP etc. can be also used as the recording medium.

<<Fixing Unit and Fixing Step>>

The fixing unit is not particularly limited as long as the fixing unit is a unit configured to fix the transfer image transferred to the recording medium. The fixing unit may be appropriately selected depending on the intended purpose. The fixing unit is preferably a heat-press member known in the art. Examples of the heat-press member include a combination of a heating roller and a press roller, and a combination of a heating roller, a press roller, and an endless belt.

The fixing step is not particularly limited as long as the fixing step is a step including fixing the visible image transferred to the recording medium. The fixing step may be appropriately selected depending on the intended purpose. For example, the fixing step may be performed every time a toner of each color is transferred to the recording medium, or the fixing step may be performed simultaneously in a state where toners of all colors are overlapped.

The fixing step can be performed by the fixing unit.

Heating by the heat-press member is typically preferably performed at from 80° C. through 200° C.

In the present disclosure, for example, a photofixing device known in the art may be used in combination with or instead of the fixing unit depending on the intended purpose.

A surface pressure applied in the fixing step is not particularly limited and may be appropriately selected depending on the intended purpose. The surface pressure is preferably from 10 $N/cm^2$ through 80 $N/cm^2$.

<<Cleaning Unit and Cleaning Step>>

The cleaning unit is not particularly limited as long as the cleaning unit is a unit capable of removing the toner remained on the photoconductor, and may be appropriately selected depending on the intended purpose. Examples of the cleaning unit include a magnetic brush cleaner, an electrostatic brush cleaner, a magnetic roller cleaner, a blade cleaner, a brush cleaner, and a web cleaner.

The cleaning step is not particularly limited as long as the cleaning step is a step including removing the toner remained on the photoconductor, and may be appropriately selected depending on the intended purpose. For example, the cleaning step can be performed by the cleaning unit.

<<Charge-eliminating Unit and Charge-eliminating Step>>

The charge-eliminating unit is not particularly limited as long as the charge-eliminating unit is a unit configured to apply charge-eliminating bias to the photoconductor to eliminate the charge of the photoconductor. The charge-eliminating unit may be appropriately selected depending on the intended purpose. Examples of the charge-eliminating unit include a charge-eliminating lamp.

The charge-eliminating step is not particularly limited as long as the charge-eliminating step is a step including applying charge-eliminating bias to the photoconductor to eliminate the charge of the photoconductor. The charge-eliminating step may be appropriately selected depending on the intended purpose. For example, the charge-eliminating step can be performed by the charge-eliminating unit.

<<Recycling Unit and Recycling Step>>

The recycling unit is not particularly limited as long as the recycling unit is a unit configured to recycle the toner removed by the cleaning step to the developing device. The recycling unit may be appropriately selected depending on the intended purpose. Examples of the recycling unit include conveyance units known in the art.

The recycling step is not particularly limited as long as the recycling step is a step including recycling the toner removed by the cleaning step to the developing device. The recycling step may be appropriately selected depending on the intended purpose. For example, the recycling step can be performed by the recycle unit.

<<Controlling Unit and Controlling Step>>

The controlling unit is not particularly limited as long as the controlling unit is a unit capable of controlling operations of each of the above-mentioned units and may be appropriately selected depending on the intended purpose. Examples of the controlling unit include devices, such as a sequencer and a computer.

The controlling step is not particularly limited as long as the controlling step is a step including controlling operations of each of the above-mentioned steps and may be appropriately selected depending on the intended purpose. For example, the controlling step can be performed by the controlling unit.

Moreover, another example of the image forming apparatus of the present disclosure is described with reference to a drawing.

Figure 4:
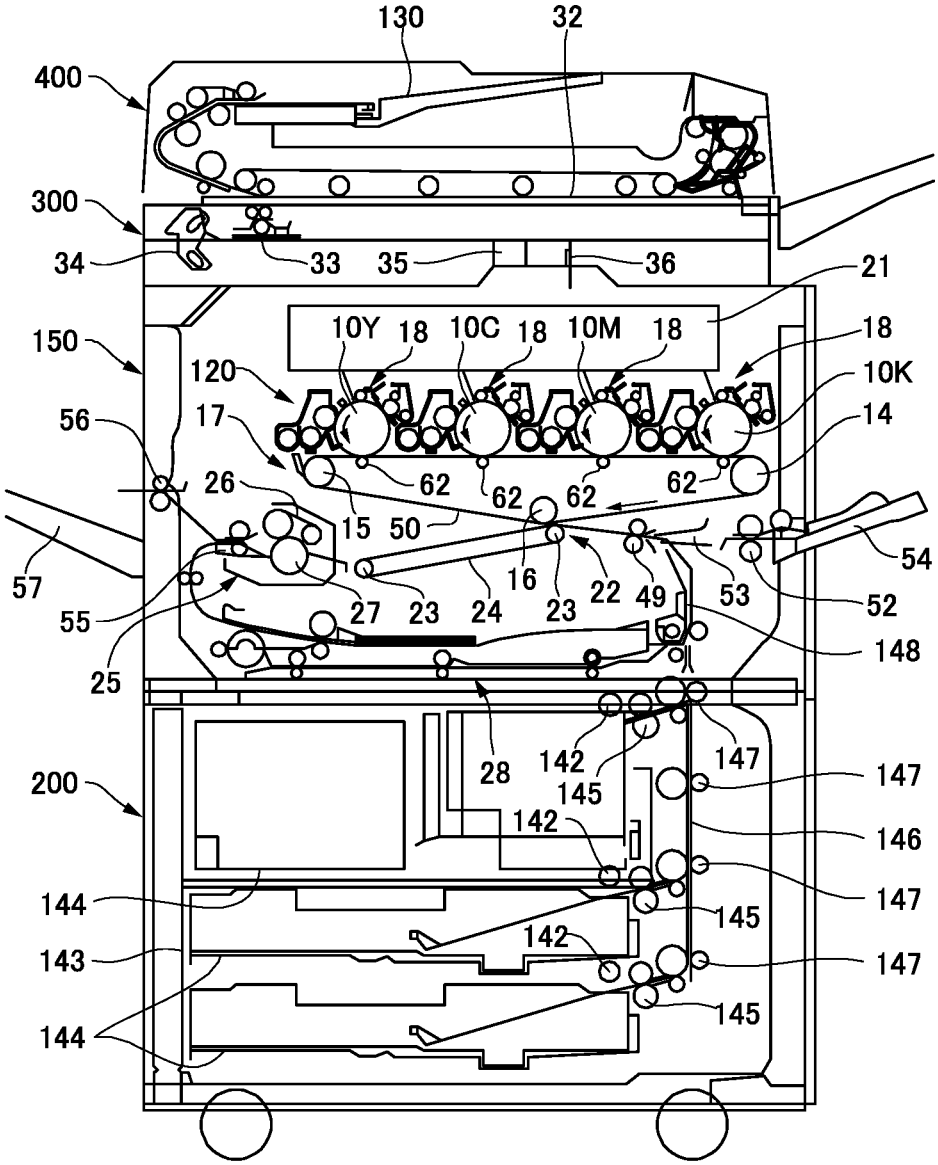
FIG. 4 is a schematic structural view illustrating one example of an image forming apparatus of the present disclosure.

The image forming apparatus illustrated in FIG. 4 includes a copier main body 150, a paper-feeding table 200, a scanner 300, and an automatic document feeder (ADF) 400.

An endless belt type intermediate transfer member 50 is disposed in a center of the copier main body 150. The intermediate transfer member 50 is supported by supporting rollers 14, 15, and 16 and is rotatable clockwise in FIG. 4. An intermediate-transfer-member cleaning device 17 configured to remove the residual toner on the intermediate transfer member 50 is disposed near the supporting roller 15. A tandem developing device 120, in which four image forming unit 18 of yellow, cyan, magenta, and black are aligned along the transporting direction of the intermediate transfer member 50 to face the intermediate transfer member 50 is disposed to the intermediate transfer member 50 supported by the supporting roller 14 and the supporting roller 15. An exposure device 21 that is the exposing member is disposed near the tandem developing device 120. A secondary transfer device 22 is disposed to the side of the intermediate transfer member 50 opposite to the side where the tandem developing device 120 is disposed. In the secondary transfer device 22, a secondary transfer belt 24 that is an endless belt is supported by a pair of rollers 23, and transfer paper transported on the secondary transfer belt 24 can be in contact with the intermediate transfer member 50. A fixing device 25 that is the fixing unit is disposed near the secondary transfer device 22. The fixing device 25 includes a fixing belt 26 that is an endless belt and a press roller 27 disposed to be pressed against the fixing belt 26.

Note that, in the tandem image forming apparatus, a sheet reverser 28 configured to reverse the transfer paper to form images on both surfaces of the transfer paper is disposed near the secondary transfer device 22 and the fixing device 25.

Next, formation of a full-color image (color copy) using a tandem developing device 120 is described. First, a document is set on a document table 130 of the automatic document feeder (ADF) 400. Alternatively, the automatic document feeder 400 is opened, a document is set on contact glass 32 of a scanner 300 and then automatic document feeder 400 is closed.

In the case where the document is set in the automatic document feeder 400, once a start switch (not illustrated) is pressed, the document is transported onto the contact glass 32, and then the scanner 300 is driven to scan the document with a first carriage 33 and a second carriage 34. In the case where the document is set on the contact glass 32, the scanner 300 is immediately driven to scan the document with the first carriage 33 and the second carriage 34. During the scanning, light is emitted towards the document from a light source of the first carriage 33 and reflection light from a surface of the document is reflected by a mirror of the second carriage 34, passed through an image forming lens 35, and then received by a read sensor 36 to thereby read a color document (a color image) to obtain image information of black, yellow, magenta, and cyan.

Figure 5:
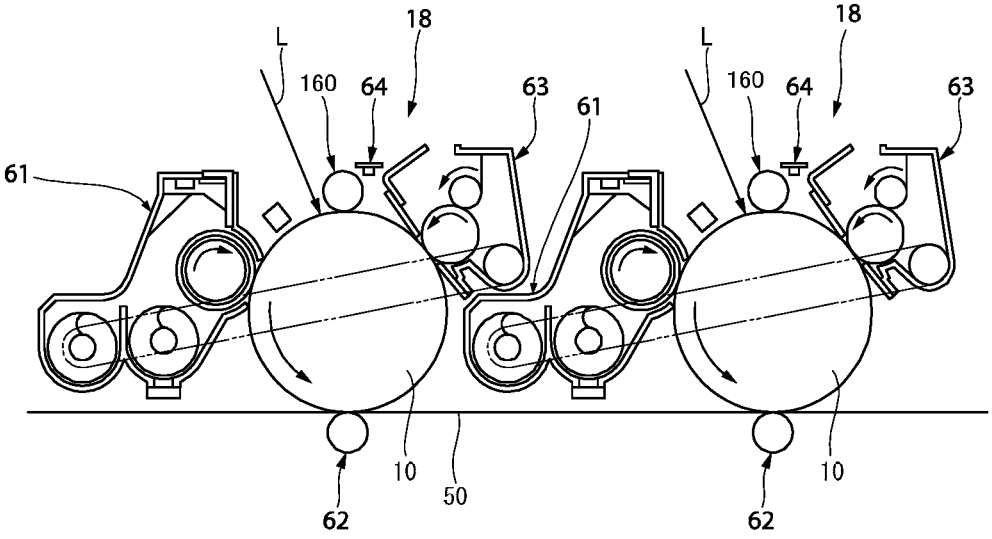
FIG. 5 is an enlarged partial view of FIG. 4.

Then, each of image information of black, image information of yellow, image information of magenta, and image information of cyan is transmitted to a respective image forming unit 18 (a black image forming unit, a yellow image forming unit, a magenta image forming unit, and a cyan image forming unit) in the tandem developing device 120. In each image forming unit, each toner image of black, yellow, magenta, or cyan is formed. Specifically, as illustrated in FIG. 5, each image forming unit 18 (the black image forming unit, the yellow image forming unit, the magenta image forming unit, and the cyan image forming unit) of the tandem developing device 120 includes an electrostatic latent image bearer 10 (an electrostatic latent image bearer for black 10K, an electrostatic latent image bearer for yellow 10Y, an electrostatic latent image bearer for magenta 10M, or an electrostatic latent image bearer for cyan 10C), a charging device 160 that is the charging member configured to uniformly charge the electrostatic latent image bearer 10, an exposing device configured to expose the electrostatic image bearer to light (L in FIG. 5) in the shape of each color image based on each color image information to form an electrostatic latent image corresponding to each color image on the electrostatic latent image bearer, a developing device 61 that is the developing unit configured to develop the electrostatic latent image with each color toner (a black toner, a yellow toner, a magenta toner, or a cyan toner) to form a toner image of each color toner, a transfer charger 62 configured to transfer the toner images into an intermediate transfer member 50, a cleaning device 63, and a charge-eliminator 64. An image of each single color (a black image, a yellow image, a magenta image, or a cyan image) can be formed by each color image information. The black image formed on the electrostatic latent image bearer for black 10K, the yellow image forming on the electrostatic latent image bearer for yellow 10Y, the magenta image forming on the electrostatic latent image bearer for magenta 10M, and the cyan image formed on the electrostatic latent image bearer for cyan 10C in the above-described manner are sequentially transferred (primary transfer) onto the intermediate transfer member 50 supported by the supporting rollers 14, 15, and 16. Then, the black image, the yellow image, the magenta image, and the cyan image are superimposed to form a composite color image (a color transfer image) on the intermediate transfer member 50.

Meanwhile, in the paper-feeding table 200, one of paper-feeding rollers 142 is selectively rotated to feed sheets (recording paper) from one of vertically stacked paper-feeding cassettes 144 housed in a paper bank 143. The sheets are separated one another by a separation roller 145. The separated sheet is fed through a paper-feeding path 146, then fed through a paper-feeding path 148 in the copier main body 150 by conveying with a conveyance roller 147, and is stopped at a registration roller 49. Alternatively, paper-feeding rollers 142 are rotated to feed sheets (recording paper) on a bypass feeder 54. The sheets are separated one another by a separation roller 52. The separated sheet is fed through a manual paper-feeding path 53 and is stopped at the registration roller 49 in the similar manner. Note that, the registration roller 49 is typically earthed for use, but bias may be applied to the registration roller 49 for use in order to remove a paper powder from the sheet. Then, the registration roller 49 is rotated synchronously to the movement of the composite color image (color transfer image) on the intermediate transfer member 50, to thereby send the sheet (recording paper) between the intermediate transfer member 50 and a secondary transfer device 22 to transfer the composite color image (color transfer image) onto the sheet (recording paper) by means of the secondary transfer device 22. As a result, the color image is transferred and formed on the sheet (recording paper). Note that, the residual toner on the intermediate transfer member 50 after image transfer is cleaned by the intermediate-transfer-member cleaning device 17.

The sheet (recording paper) onto which the color image has been transferred and formed is transported by the secondary transfer device 22 and is sent to a fixing device 25. In the fixing device 25, the composite color image (color transfer image) is fixed onto the sheet (recording paper) by heat and pressure. Thereafter, the traveling direction of the sheet (recording paper) is changed by the switch craw 55 to eject the sheet by an ejecting roller 56 to stack the sheet on a paper ejection tray 57. Alternatively, the sheet is sent to the sheet reverser 28 by changing the traveling direction of the sheet with the switch craw 55. The sheet is reversed by the sheet reverser 28 to again guide to a transfer position. After recording an image also on a back side of the sheet, the sheet is ejected by the ejecting roller 56 to stack the sheet on the paper ejection tray 57.

EXAMPLES

The present disclosure will be described more detail by way of Examples. However, the present disclosure should not be construed as being limited to these Examples. Note that, "part(s)" denotes "part(s) by mass" unless otherwise stated, and "%" denotes "% by mass" unless otherwise stated.

Measuring methods of various physical properties in Synthesis Examples, Examples, and Comparative Examples are described below.

<Molecular Weight>

Device: GPC (available from Tosoh Corporation), Detector: RI,

Measuring temperature: 40° C.

Mobile phase: tetrahydrofuran, flow rate: 0.45 mL/min.

A number average molecular weight (Mn), a weight average molecular weight (Mw), and a molecular weight distribution (Mw/Mn) are a number average molecular weight, a weight average molecular weight, and a molecular weight distribution measured by gel permeation chromatography (GPC) using as a standard a calibration curve prepared using polystyrene samples molecular weights of which have been known. Note that, as columns, a column the exclusion limit of which was 60,000, a column the exclusion limit of which was 20,000, and a column the exclusion limit of which was 10,000 connected in series were used.

<Softening Temperature>

After preheating 1 g of a measurement sample at 50° C. by means of a flow test capillary rheometer (CFT-500D, available from Shimadzu Corporation), a load of 30 kg was applied to a plunger with heating the sample at the heating speed of 5° C./min, and the sample was pushed out from a nozzle having a diameter of 0.5 mm and a length of 1 mm. The "lowered amount of the plunger (flow amount)" and the "temperature" were plotted on a graph, and a temperature corresponding to ½ the maximum value of the lowered amount of the plunger was read from the graph and the value (a temperature at which a half of the measurement sample was flown out) was determined as a softening temperature.

<Glass Transition Temperature (Tg), Melting Point (Tm), and Crystallization Temperature (Tc)>

In the case where the binder resin was extracted from the toner, 1 g of the toner was weighed, the collected toner was placed in cylindrical filter paper No86R and was set in Soxhlet extractor. Soxhlet extraction was performed for 7 hours under reflux using 200 mL of hexane as a solvent. After washing the obtained residue with 200 mL of hexane, the residue was dried under reduced pressure for 24 hours at 40° C., followed by for 24 hours at 60° C., to thereby remove the residual solvent. The resultant was subjected to annealing for 24 hours at 40° C., and for further 24 hours at 45° C. to perform crystallization of crystalline polyester.

Each of thermal properties of the measurement sample was measured by means of a differential scanning calorimeter (DSC) (Q2000, available from TA Instruments) under the following conditions. Specifically, the measurement was performed in the following manner.

(Measuring Conditions)

Sample container: aluminium sample pan (with a lid)

Amount of sample: 5 mg

Reference aluminium sample pan (empty container)

Atmosphere: nitrogen (flow rate: 50 mL/min)

Starting temperature: −20° C.

Heating speed: 10° C./min

Ending temperature: 130° C.

Retention time: 1 min

Cooling speed: 10° C./min

Ending temperature: −50° C.

Retention time: 5 min

Heating temperature: 10° C./min

Ending temperature: 130° C.

The measurement was performed under the measuring conditions above to prepare a graph plotting an "amount of heat absorbed or released" and a "temperature."

A characteristic curve observed in the first heating process was determined as a glass transition temperature (Tg). Note that, as Tg, a value obtained from the DSC curve by the midpoint method was used.

A temperature of an apex of a melting (endothermic) peak obtained in each of the first heating process and the second heating process is determined as a melting point. Moreover, an amount of heat of fusion was calculated by determining absorption of heat in the heating process as a melting region.

A crystallization peak temperature was determined as a temperature of an apex of a crystallization (exothermic) peak obtained in the cooling process.

An amount of heat of crystallization was calculated by determining release of heat in the range of from 40° C. through 70° C. in the cooling process as a crystallization region.

<Measurement of Amount (% by Mass) of Crystalline Resin by DSC>

An amount of the crystalline resin in the toner was determined by DSC.

A ratio measuring method of an amount of the crystalline resin was as follows.

A total amount of the crystalline resin in the toner particles was obtained by differential scanning calorimetry (DSC). A toner sample and a single crystalline resin sample were each measured by the following measuring device and conditions. From a ratio between the obtained amount of heat absorbed in the crystalline resin of the toner sample and the obtained amount of heat absorbed in the crystalline resin of the single crystalline resin sample, an amount of the crystalline resin in the toner was determined.

Measuring device: DSC (DSC60, available from Shimadzu Corporation)

Amount of sample: about 5 mg

Heating temperature: 10° C./min

Measurement range: from room temperature through 150° C.

Measuring environment: in nitrogen gas atmosphere

A total amount of the crystalline resin is calculated by Formula 1 below.

Total amount of crystalline resin (% by mass)= (amount of heat (J/g) absorbed in crystalline resin of toner sample)×100)/(amount of heat (J/g) absorbed in single crystalline resin) (Formula 1)

Synthesis Example 1

<Synthesis of Amorphous Polyester A1>

A 5 L four-necked flask equipped with a nitrogen-inlet tube, a dehydration tube, a stirrer, and a thermocouple was charged with propylene glycol as diol, and terephthalic acid and succinic acid as dicarboxylic acids in a manner that a molar ratio (terephthalic acid/succinic acid) was to be 80/20, and OH/COOH was to be 2.0. After sufficiently purging the reaction vessel with nitrogen gas, 300 ppm (relative to monomers) of titanium tetraisopropoxide was added. Under nitrogen gas flow, a temperature was elevated to 200° C. for about 4 hours, followed by elevating the temperature to 230° C. for 2 hours, and a reaction was performed until generation of an effluent stopped. Thereafter, the reaction was performed for 4 hours under the reduced pressure of from 10 mmHg through 30 mmHg, to thereby obtain [Amorphous Polyester A1].

The obtained resin had an acid value (AV) of 1.3 mgKOH/g, a hydroxyl value (OHV) of 12.3 mgKOH/g, a glass transition temperature (Tg) of 62.8° C., a softening temperature of 140.6° C., and a weight average molecular weight (Mw) of 14,400.

Synthesis Example 2

<Synthesis of Amorphous Polyester A2>

A 5 L four-necked flask equipped with a nitrogen-inlet tube, a dehydration tube, a stirrer, and a thermocouple was charged with propylene glycol and tremethylol propane as polyvalent alcohols in a manner that a molar ratio (propyleneglycol/trimethylolpropane) was to be 97.5/2.5, and was charged with terephthalic acid and succinic acid as dicarboxylic acids in a manner that a molar ratio (terephthalic acid/succinic acid) was to be 78/22, and OH/COOH was to be 1.4. After sufficiently purging the reaction vessel with nitrogen gas, 300 ppm (relative to monomers) of titanium tetraisopropoxide was added. Under nitrogen gas flow, a temperature was elevated to 200° C. for about 4 hours, followed by elevating the temperature to 230° C. for 2 hours, and a reaction was performed until generation of an effluent stopped. Thereafter, the reaction was performed for 2 hours under the reduced pressure of from 10 mmHg through 30 mmHg, to thereby obtain [Amorphous Polyester A2].

The obtained resin has an acid value (AV) of 1.4 mgKOH/g, a hydroxyl value (OHV) of 24.0 mgKOH/g, a glass transition temperature (Tg) of 60.2° C., a softening temperature of 151.0° C., and a weight average molecular weight (Mw) of 22,800.

Synthesis Example 3

<Synthesis of Crystalline Polyester B1>

A 5 L four-necked flask equipped with a nitrogen-inlet tube, a dehydration tube, a stirrer, and a thermocouple was charged with 1,4-butanediol as diol and dodecanedioic acid as dicarboxylic acid in a manner that a molar ratio between the diol and the dicarboxylic acid was to be OH/COOH=1.10. After sufficiently purging the reaction vessel with nitrogen gas, 300 ppm of titanium tetraisopropoxide relative to the monomer was added. Under nitrogen gas flow, a temperature was elevated to 200° C. for about 4 hours, followed by elevating the temperature to 230° C. for 2 hours, and a reaction was performed until generation of an effluent stopped. Thereafter, the reaction was performed for 4 hours under the reduced pressure of from 10 mmHg through 30 mmHg, to thereby obtain [Crystalline Polyester B1].

The obtained resin had an acid value (AV) of 4.8 mgKOH/g, a hydroxyl value (OHV) of 22.4 mgKOH/g, a melting point (Tm) of 72.9° C., an amount of heat of fusion of 103.3 J/g, a crystallization temperature (Tc) of 56.5° C., and a weight average molecular weight (Mw) of 18,500.

Synthesis Example 4

<Synthesis of Crystalline Polyester B2>

A 5 L four-necked flask equipped with a nitrogen-inlet tube, a dehydration tube, a stirrer, and a thermocouple was charged with ethylene glycol as diol and sebacic acid as dicarboxylic acid in a manner that a molar ratio between the diol and the dicarboxylic acid was to be OH/COOH=1.10. After sufficiently purging the reaction vessel with nitrogen gas, 300 ppm of titanium tetraisopropoxide relative to the monomer was added. Under nitrogen gas flow, a temperature was elevated to 200° C. for about 4 hours, followed by elevating the temperature to 230° C. for 2 hours, and a reaction was performed until generation of an effluent stopped. Thereafter, the reaction was performed for 4 hours under the reduced pressure of from 10 mmHg through 30 mmHg, to thereby obtain [Crystalline Polyester B2].

The obtained resin had an acid value (AV) of 0.67 mgKOH/g, a hydroxyl value (OHV) of 26.3 mgKOH/g, a melting point (Tm) of 78.2° C., an amount of heat of fusion of 146.3 J/g, a crystallization temperature (Tc) of 49.0° C., and a weight average molecular weight (Mw) of 17,000.

Synthesis Example 5

<Synthesis of Crystalline Polyester B3>

A 5 L four-necked flask equipped with a nitrogen-inlet tube, a dehydration tube, a stirrer, and a thermocouple was charged with 1,4-butanediol as diol and sebacic acid as dicarboxylic acid in a manner that a molar ratio between the diol and the dicarboxylic acid was to be OH/COOH=1.10. After sufficiently purging the reaction vessel with nitrogen gas, 300 ppm of titanium tetraisopropoxide relative to the monomer was added. Under nitrogen gas flow, a temperature was elevated to 200° C. for about 4 hours, followed by elevating the temperature to 230° C. for 2 hours, and a reaction was performed until generation of an effluent stopped. Thereafter, the reaction was performed for 4 hours under the reduced pressure of from 10 mmHg through 30 mmHg, to thereby obtain [Crystalline Polyester B3].

The obtained resin had an acid value (AV) of 0.45 mgKOH/g, a hydroxyl value (OHV) of 26.3 mgKOH/g, a melting point (Tm) of 64.4° C., an amount of heat of fusion of 96.7 J/g, a crystallization temperature (Tc) of 46.1° C., and a weight average molecular weight (Mw) of 16,700.

Synthesis Example 6

<Synthesis of Crystalline Polyester B4>

A 5 L four-necked flask equipped with a nitrogen-inlet tube, a dehydration tube, a stirrer, and a thermocouple was charged with 1,6-hexanediol as diol and dodecanedioic acid as dicarboxylic acid in a manner that a molar ratio between the diol and dicarboxylic acid was to be OH/COOH=1.05. After sufficiently purging the reaction vessel with nitrogen gas, 300 ppm of titanium tetraisopropoxide relative to the monomer was added. Under nitrogen gas flow, a temperature was elevated to 200° C. for about 4 hours, followed by elevating the temperature to 230° C. for 2 hours, and a reaction was performed until generation of an effluent stopped. Thereafter, the reaction was performed for 4 hours under the reduced pressure of from 10 mmHg through 30 mmHg, to thereby obtain [Crystalline Polyester B4].

The obtained resin had an acid value (AV) of 1.0 mgKOH/g, a hydroxyl value (OHV) of 23.2 mgKOH/g, a melting point (Tm) of 75.0° C., an amount of heat of fusion of 112.7 J/g, a crystallization temperature (Tc) of 58.4° C., and a weight average molecular weight (Mw) of 15,500.

Synthesis Example 7

<Synthesis of Crystalline Polyester B5>

A 5 L four-necked flask equipped with a nitrogen-inlet tube, a dehydration tube, a stirrer, and a thermocouple was charged with 1,10-decanediol as diol and sebacic acid as dicarboxylic acid in a manner that a molar ratio between the diol and the dicarboxylic acid was to be OH/COOH=1.05. After sufficiently purging the reaction vessel with nitrogen gas, 300 ppm of titanium tetraisopropoxide relative to the monomer was added. Under nitrogen gas flow, a temperature was elevated to 200° C. for about 4 hours, followed by elevating the temperature to 230° C. for 2 hours, and a reaction was performed until generation of an effluent stopped. Thereafter, the reaction was performed for 4 hours under the reduced pressure of from 10 mmHg through 30 mmHg, to thereby obtain [Crystalline Polyester B5].

The obtained resin had an acid value (AV) of 0.80 mgKOH/g, a hydroxyl value (OHV) of 25.2 mgKOH/g, a melting point (Tm) of 77.4° C., an amount of heat of fusion of 112.4 J/g, a crystallization temperature (Tc) of 59.3° C., and a weight average molecular weight (Mw) of 15,800.

Synthesis Example 8

<Synthesis of Crystalline Polyester B6>

A 5 L four-necked flask equipped with a nitrogen-inlet tube, a dehydration tube, a stirrer, and a thermocouple was charged with 1,6-hexanediol as diol and sebacic acid as dicarboxylic acid in a manner that a molar ratio between the diol and the dicarboxylic acid was to be OH/COOH=1.02. After sufficiently purging the reaction vessel with nitrogen gas, 300 ppm of titanium tetraisopropoxide relative to the monomer was added. Under nitrogen gas flow, a temperature was elevated to 200° C. for about 4 hours, followed by elevating the temperature to 230° C. for 2 hours, and a reaction was performed until generation of an effluent stopped. Thereafter, the reaction was performed for 4 hours under the reduced pressure of from 10 mmHg through 30 mmHg, to thereby obtain [Crystalline Polyester B6].

The obtained resin had an acid value (AV) of 0.45 mgKOH/g, a hydroxyl value (OHV) of 18.0 mgKOH/g, a melting point (Tm) of 70.8° C., an amount of heat of fusion of 115.6 J/g, a crystallization temperature (Tc) of 52.1° C., and a weight average molecular weight (Mw) of 19,300.

Synthesis Example 9

<Synthesis of Crystalline Polyester B7>

A 5 L four-necked flask equipped with a nitrogen-inlet tube, a dehydration tube, a stirrer, and a thermocouple was charged with ethylene glycol as diol and dodecanedioic acid as dicarboxylic acid in a manner that a molar ratio between the diol and the dicarboxylic acid was to be OH/COOH=1.08. After sufficiently purging the reaction vessel with nitrogen gas, 300 ppm of titanium tetraisopropoxide relative to the monomer was added. Under nitrogen gas flow, a temperature was elevated to 200° C. for about 4 hours, followed by elevating the temperature to 230° C. for 2 hours, and a reaction was performed until generation of an effluent stopped. Thereafter, the reaction was performed for 4 hours under the reduced pressure of from 10 mmHg through 30 mmHg, to thereby obtain [Crystalline Polyester B7].

The obtained resin had an acid value (AV) of 1.5 mgKOH/g, a hydroxyl value (OHV) of 24.5 mgKOH/g, a melting point (Tm) of 85.4° C., an amount of heat of fusion of 83.0 J/g, a crystallization temperature (Tc) of 63.9° C., and a weight average molecular weight (Mw) of 16,300.

Synthesis Example 10

<Synthesis of Crystalline Polyester B8>

A 5 L four-necked flask equipped with a nitrogen-inlet tube, a dehydration tube, a stirrer, and a thermocouple was charged with 1,4-butanediol as diol and dodecanedioic acid as dicarboxylic acid in a manner that a molar ratio between the diol and the dicarboxylic acid was to be OH/COOH=1.08. After sufficiently purging the reaction vessel with nitrogen gas, 300 ppm of titanium tetraisopropoxide relative to the monomer was added. Under nitrogen gas flow, a temperature was elevated to 200° C. for about 4 hours, followed by elevating the temperature to 230° C. for 2 hours, and a reaction was performed until generation of an effluent stopped. Thereafter, the reaction was performed for 2 hours under the reduced pressure of from 10 mmHg through 30 mmHg, to thereby obtain [Crystalline Polyester B8].

The obtained resin had an acid value (AV) of 15.8 mgKOH/g, a hydroxyl value (OHV) of 30.9 mgKOH/g, a melting point (Tm) of 72.9° C., an amount of heat of fusion of 107.1 J/g, a crystallization temperature (Tc) of 56.6° C., and a weight average molecular weight (Mw) of 9,800.

(Preparation of Black Colorant Dispersion Liquid)

In 80 parts of ethyl acetate, 17 parts of carbon black (RegaL400, available from Cabot Corporation) and 3 parts of a pigment dispersant were primary dispersed using a mixer having a stirring blade.

As the pigment disperser, AJISPER PB821 (available from Ajinomoto Fine-Techno Co., Inc.) was used.

The obtained primary dispersion liquid was finely dispersed by applying strong shearing force using a bead mill (LMZ, available from Ashizawa Finetech Ltd., diameters of zirconia beads: 0.3 mm) to prepare a secondary dispersion liquid (black colorant dispersion liquid) from which aggregates of 5 μm or greater had been completely removed.

(Preparation of Release Agent Dispersion Liquid)

In 80 parts of ethyl acetate, 15.4 parts of a carnauba release agent and 4.6 parts of a release agent disperser were primary dispersed by means of a mixer having a stirring blade.

After heating the obtained primary dispersion liquid to 80° C. with stirring to dissolve the carnauba release agent, the temperature of the dispersion liquid was reduced to room temperature to precipitate the release agent particles in a manner that the maximum particle diameter of the release agent particles was to be 3 μm or smaller.

As the release agent disperser, a polyethylene release agent to which a styrene-butyl acrylate copolymer was grafted was used.

The obtained dispersion liquid was further finely dispersed by applying strong shearing force using a bead mill (LMZ, available from Ashizawa Finetech Ltd., diameters of zirconia beads: 0.3 mm). The resultant dispersion liquid was adjusted in a manner that the maximum particle diameter of the release agent particles was to be 1 pm or smaller to thereby obtain a release agent dispersion liquid.

Example 1

<Preparation of Toner Composition Liquid>

Each of the dispersion liquids or solutions were homogeneously dispersed with stirring for 10 minutes using a mixer having a stirring blade in a heating environment of 60° C. in a manner that the binder resin [Amorphous Polyester A1/Crystalline Polyester B1=90/10 (mass ratio)], the colorant, and the release agent formed the composition as presented in Table 1, to thereby obtain a toner composition liquid. The pigment and release agent particles were not aggregated by the shock applied by dilution with a solvent. Ethyl acetate was used as the solvent.

TABLE 1

| | Binder resin (parts by mass) | Release agent (parts by mass) | Release agent disperser (parts by mass) | Colorant (carbon black) (parts by mass) | Charge controlling agent (FCA-2530N) (parts by mass) | Solid content (% by mass) |
|---|---|---|---|---|---|---|
| Toner composition | 100 | 6 | 1.8 | 8.4 | 1.5 | 10 |

<Production of Tone>

The toner composition liquid was ejected as droplets by means of a toner production device of FIG. 2 having a droplet ejection head as illustrated in FIG. 3 as a droplet ejecting unit under the following conditions. Thereafter, the droplets were dried and solidified, and then collected by a cyclone. Thereafter, the collected particles were secondary dried for 48 hours at 35° C. to thereby produce Toner 1.

—Conditions of Liquid Column Resonance—

Resonance mode: N=2

Length between both edges of a liquid column resonance liquid chamber along the longitudinal direction: L=1.8 mm Height of an edge of the liquid-column-resonance liquid chamber at the side of the liquid common supply path: h1=80 μm Height of a communication port of the liquid-column-resonance liquid chamber: h2=40 μm —Conditions for Producing Toner Base Particles—

Specific gravity of the dispersion liquid: $\rho$=1.1 g/cm$^3$

Shape of a discharge port: true circle

Diameter of the discharge port: 7.5 μm

The number of openings of the discharge ports: 4 per liquid column resonance liquid chamber Minimum gap between centers of the adjacent discharge ports: 130 μm (all equal gaps)

Dry air temperature: 40° C.

Apply voltage: 10.0 V

Driving frequency: 395 kHz

<Production of Carrier>

Raw materials below were dispersed for 20 minutes by a homomixer to prepare a resin layer coating liquid. Thereafter, the resin layer coating liquid was applied to a surface of spherical ferrite (1,000 parts) having a volume average particle diameter of 35 μm by means of a fluidized-bed coating device to produce a carrier.

[Raw Materials]

Silicone resin (organo straight silicone): 100 parts

γ-(2-aminoethypaminopropyltrimethoxysilane: 5 parts

Carbon black: 10 parts

Toluene: 100 parts

<Production of Developer>

A developer was produced by mixing 5 parts of Toner 1 and 95 parts of the carrier.

<Evaluations>

The following evaluations were performed. The results are presented in Table 2-1 and Table 2-2.

<<Minimum Fixing Temperature>>

A solid image (image size: 3 cm×8 cm) was formed on an entire surface of transfer paper (photocopy printing sheet <70>available from RICOH JAPAN Corp.) with a toner deposition amount of 0.85±0.10 mg/cm$^2$ after transfer by means of a tandem full-color image forming apparatus illustrated in FIG. 4.

Fixing was performed with varying a temperature of a fixing belt. A surface of the obtained fixed image was scratched with a ruby needle (radius of a tip: from 260 μm through 320 μm, point angle: 60°) at a load of 50 g by means of a scratch drawing testing device AD-401 (available from Ueshima Seisakusho Co., Ltd.). The drawn surface was then strongly rubbed 5 times with fibers (HANICOT #440, available from Haniron K.K.). The temperature of the fixing belt at which scraping of the image was almost nonexistent was regarded as the minimum fixing temperature. The solid image was formed at the position that was 3.0 cm apart from the edge of the transfer paper along the feeding direction. The speed for passing the paper through the nip of the fixing device was 280 mm/s. The lower the minimum fixing temperature is, the more preferable low-temperature fixing ability of the toner is. Therefore, the low-temperature fixing ability was evaluated using the minimum fixing temperature based on the following criteria.

[Evaluation Criteria]

A: The minimum fixing temperature was 120° C. or lower.

B: The minimum fixing temperature was higher than 120° C. but 125° C. or lower.

C: The minimum fixing temperature was higher than 125° C. but 130° C. or lower.

D: The minimum fixing temperature was higher than 130° C.

<<Storage Stability (Penetration Degree)>>

A 50 mL glass container was charged with each toner and was then left to stand in a thermostat of 50° C. for 24 hours. The toner was cooled to 24° C. and was subjected to a measurement of a penetration degree (mm) by means of a penetration degree tester (JISK2235-1991). The result was evaluated based on the following criteria. The larger the value of the penetration degree is, the more preferable heat resistant storage stability of the toner is. When the penetration degree is less than 5 mm, it is most likely that a problem occurs at the time of use.

In the present disclosure, the penetration degree is represented by a penetration depth (mm).

[Evaluation Criteria]

A: The penetration degree was 10 mm or greater.

B: The penetration degree was 6 mm or greater but less than 10 mm.

C: The penetration degree was 3 mm or greater but less than 6 mm.

D: The penetration degree was less than 3 mm.

<<Image Strength (Stacking Properties)>>

By means of the image forming apparatus illustrated in FIG. 4, 30 sheets in the size of A4 on an entire surface of each of which an unfixed solid image (toner deposition amount: 0.85 mg/cm$^2$) was formed were continuously passed through the fixing device. Then, the sheets were immediately stacked up and 100 sheets in the size of A4 were stacked thereon to apply a load. After leaving for 10 minutes, the state of the images was evaluated based on the following criteria.

[Evaluation Criteria]

I: The sheets were not adhered to each other and were released from each other immediately.

II: The sheets were slightly adhered to each other but no mark was left on the images after the sheets were released from each other.

III: The sheets were strongly adhered to each other and the toner on the images was peeled when the sheets were released from each other with force.

Example 2

Toner 2 was prepared in the same manner as in Example 1, except that as crystalline polyester, Crystalline Polyester B4 was used instead of Crystalline Polyester B1.

The measurements of various property values and evaluations were performed in the same manner as in Example 1. The results are presented in Table 2-1 and Table 2-2.

Example 3

Toner 3 was prepared in the same manner as in Example 1, except that as crystalline polyester, Crystalline Polyester B5 was used instead of Crystalline Polyester B1.

The measurements of various property values and evaluations were performed in the same manner as in Example 1. The results are presented in Table 2-1 and Table 2-2.

Example 4

Toner 4 was prepared in the same manner as in Example 1, except that the mass ratio of Amorphous Polyester A1/Crystalline Polyester B1 in the binder resin was changed from 90/10 to 95/5.

The measurements of various property values and evaluations were performed in the same manner as in Example 1. The results are presented in Table 2-1 and Table 2-2.

Example 5

Toner 5 was prepared in the same manner as in Example 1, except that the mass ratio of Amorphous Polyester A1/Crystalline Polyester B1 in the binder resin was changed from 90/10 to 80/20.

The measurements of various property values and evaluations were performed in the same manner as in Example 1. The results are presented in Table 2-1 and Table 2-2.

Example 6

Toner 6 was prepared in the same manner as in Example 1, except that as the crystalline polyester Crystalline Polyester B6 was used instead of Crystalline Polyester B1, and the mass ratio of Amorphous Polyester A1/Crystalline Polyester B6 in the binder resin was changed from 90/10 to 85/15.

The measurements of various property values and evaluations were performed in the same manner as in Example 1. The results are presented in Table 2-1 and Table 2-2.

Example 7

Toner 7 was prepared in the same manner as in Example 1, except that as the amorphous polyester, Amorphous Polyester A2 was used instead of Amorphous Polyester A1.

The measurements of various property values and evaluations were performed in the same manner as in Example 1. The results are presented in Table 2-1 and Table 2-2.

Example 8

Toner 8 was prepared in the same manner as in Example 1, except that as the crystalline polyester, Crystalline Polyester B7 was used instead of Crystalline Polyester B1.

The measurements of various property values and evaluations were performed in the same manner as in Example 1. The results are presented in Table 2-1 and Table 2-2.

Example 9

Toner 9 was prepared in the same manner as in Example 1, except that the mass ratio of Amorphous Polyester A1/Crystalline Polyester B1 in the binder resin was changed from 90/10 to 97/3.

The measurements of various property values and evaluations were performed in the same manner as in Example 1. The results are presented in Table 2-1 and Table 2-2.

Example 10

Toner 10 was prepared in the same manner as in Example 1, except that the mass ratio of Amorphous Polyester A1/Crystalline Polyester B1 in the binder resin was changed from 90/10 to 85/15.

The measurements of various property values and evaluations were performed in the same manner as in Example 1. The results are presented in Table 2-1 and Table 2-2.

Comparative Example 1

Toner 11 was prepared in the same manner as in Example 1, except that as the crystalline polyester, Crystalline Polyester B2 was used instead of Crystalline Polyester B1.

The measurements of various property values and evaluations were performed in the same manner as in Example 1. The results are presented in Table 2-1 and Table 2-2.

Comparative Example 2

Toner 12 was prepared in the same manner as in Example 1, except that as the crystalline polyester, Crystalline Polyester B3 was used instead of Crystalline Polyester B1.

The measurements of various property values and evaluations were performed in the same manner as in Example 1. The results are presented in Table 2-1 and Table 2-2.

Comparative Example 3

Toner 13 was prepared in the same manner as in Example 1, except that the crystalline polyester was not used.

The measurements of various property values and evaluations were performed in the same manner as in Example 1. The results are presented in Table 2-1 and Table 2-2.

Comparative Example 4

Toner 14 was prepared in the same manner as in Example 1, except that the mass ratio of Amorphous Polyester A1/Crystalline Polyester B1 in the binder resin was changed from 90/10 to 70/30.

The measurements of various property values and evaluations were performed in the same manner as in Example 1. The results are presented in Table 2-1 and Table 2-2.

Comparative Example 5

Toner 15 was prepared in the same manner as in Example 1, except that as the crystalline polyester, Crystalline Polyester B6 was used instead of Crystalline Polyester B1.

The measurements of various property values and evaluations were performed in the same manner as in Example 1. The results are presented in Table 2-1 and Table 2-2.

Comparative Example 6

Toner 16 was prepared in the same manner as in Example 1, except that as the crystalline polyester, Crystalline Polyester B8 was used instead of Crystalline Polyester B1.

The measurements of various property values and evaluations were performed in the same manner as in Example 1. The results are presented in Table 2-1 and Table 2-2.

TABLE 2-1

| | Toner | Tc (° C.) | Amount of heat of crystallization (J/g) | Amount of heat of fusion (J/g) | | | Tg (° C.) | | | Amount of crystalline resin calculated by DSC (%) |
|---|---|---|---|---|---|---|---|---|---|---|
| | | | | 1st | 2nd | 2nd/1st | 1st | 2nd | 1st − 2nd | |
| Ex. 1 | 1 | 56 | 2.5 | 7.1 | 6.8 | 0.96 | 53.3 | 54.0 | −0.7 | 6.9 |
| Ex. 2 | 2 | 59 | 2.9 | 8.5 | 8.2 | 0.96 | 55.6 | 56.0 | −0.4 | 7.5 |
| Ex. 3 | 3 | 60 | 2.8 | 7.9 | 7.0 | 0.89 | 55.0 | 55.8 | −0.8 | 7.0 |
| Ex. 4 | 4 | 46 | 1.7 | 3.1 | 3.0 | 0.97 | 50.8 | 53.0 | −2.2 | 3.0 |
| Ex. 5 | 5 | 57 | 11.5 | 16.9 | 16.0 | 0.95 | 49.9 | 51.8 | −1.9 | 16.0 |
| Ex. 6 | 6 | 37 | 1.5 | 11.0 | 6.8 | 0.62 | 48.4 | 48.9 | −0.5 | 9.5 |
| Ex. 7 | 7 | 56 | 4.6 | 7.5 | 7.3 | 0.97 | 57.3 | 54.5 | 2.8 | 7.3 |
| Ex. 8 | 8 | 45 | 1.7 | 7.0 | 3.7 | 0.53 | 44.6 | 38.5 | 6.1 | 8.4 |
| Ex. 9 | 9 | 40 | 1.0 | 1.7 | 1.3 | 0.76 | 55.1 | 54.5 | 0.6 | 1.6 |
| Ex. 10 | 10 | 55 | 9.0 | 13.8 | 13.4 | 0.97 | 50.1 | 50.3 | −0.2 | 13.0 |
| Comp. Ex. 1 | 11 | — | 0 | 4.5 | 0 | 0 | 48.3 | 38.6 | 9.7 | 3.1 |
| Comp. Ex. 2 | 12 | — | 0 | 7.7 | 0 | 0 | 48.9 | 40.1 | 8.8 | 8.0 |
| Comp. Ex. 3 | 13 | — | — | — | — | — | — | — | — | — |
| Comp. Ex. 4 | 14 | 57 | 20 | 24.2 | 22.9 | 0.95 | 48.4 | 49.5 | −1.1 | 24.0 |
| Comp. Ex. 5 | 15 | 33 | 0.6 | 8.1 | 5.0 | 0.62 | 45.1 | 40.9 | 4.2 | 7.0 |
| Comp. Ex. 6 | 16 | 35 | 0.3 | 7.4 | 5.8 | 0.78 | 48.9 | 43.6 | 5.3 | 6.9 |

In Table 2-1, a deference between the amount of heat of crystallization being "0 J/g" and the amount of heat of crystallization being "-" was whether the crystalline polyester resin was included in the toner or not. When the toner included the crystalline polyester and there was no amount of heat due to crystallization in the range of from 40° C. through 70° C. in the heating process of DSC, the amount of heat of crystallization was determined as "0 J/g." When the toner did not include the crystalline polyester resin, the amount of heat of crystallization was determined as "-."

TABLE 2-2

| | Minimum fixing | Storage stability | Stacking Properties |
|---|---|---|---|
| Ex. 1 | A | A | I |
| Ex. 2 | A | A | I |
| Ex. 3 | A | A | I |
| Ex. 4 | A | B | I |
| Ex. 5 | A | A | II |
| Ex. 6 | A | C | II |
| Ex. 7 | B | A | I |
| Ex. 8 | A | B | II |
| Ex. 9 | B | B | I |
| Ex. 10 | A | A | I |
| Comp. Ex. 1 | A | D | III |
| Comp. Ex. 2 | A | D | III |
| Comp. Ex. 3 | D | A | I |
| Comp. Ex. 4 | A | B | III |
| Comp. Ex. 5 | A | C | III |
| Comp. Ex. 6 | A | B | III |

For example, embodiments of the present disclosure are as follows.

<1> A toner including:

polyester, wherein an amount of heat of a peak derived from the polyester in a range of from 40° C. through 70° C. during a cooling process is from 1.0 J/g through 15 J/g in differential scanning calorimetry performed under conditions below, <measuring conditions> after maintaining the toner at −20° C., heating the toner to 130° C. at 10° C./min (a first heating process), after maintaining the toner at 130° C. for 1 minute, cooling the toner to −50° C. at cooling speed of 10° C./min (the cooling process), and after maintaining the toner at −50° C. for 5 minutes, heating the toner to 130° C. at 10° C./min (a second heating process).

<2> The toner according to <1>, wherein a temperature of the peak during the cooling process is 40° C. or higher.

<3> The toner according to <1> or <2>, wherein the toner satisfies Formula (1) below in the differential scanning calorimetry, $$(Mt_{2nd}/Mt_{1st}) \geq 0.70 \quad \text{Formula (1)}$$

where $Mt_{1st}$ is an amount of heat of fusion (J/g) in the first heating process and $Mt_{2nd}$ is an amount of heat of fusion (J/g) in the second heating process.

<4> The toner according to any one of <1> to <3>, wherein the toner satisfies Formula (2) below in the differential scanning calorimetry, $$-5° \text{ C.} \leq (Tg_{1st} - Tg_{2nd}) \leq 5° \text{ C.} \quad \text{Formula (2)}$$

where $Tg_{1st}$ is a glass transition temperature (° C.) in the first heating process and $Tg_{2nd}$ is a glass transition temperature (° C.) in the second heating process.

<5> The toner according to any one of <1> to <4>, wherein the polyester includes amorphous polyester, and the amorphous polyester has a weight average molecular weight of from 5,000 through 35,000 and a glass transition temperature of from 50° C. through 80° C.

<6> The toner according to any one of <1> to <5>, wherein the polyester includes polyester appearing as the peak, and the polyester appearing as the peak has a weight average molecular weight of from 10,000 through 35,000 and a melting point of from 60° C. through 120° C.

<7> The toner according to <6>, wherein the toner includes a binder resin including the polyester, and an amount of the polyester appearing as the peak is from 3 parts by mass through 20 parts by mass relative to 100 parts by mass of the binder resin.

<8> The toner according to any one of <1> to <7>, wherein the polyester includes polyester appearing as the peak, and an amount of a crystalline resin including the polyester appearing as the peak is 1% by mass or greater but 20% by mass or less in the toner based on a value obtained through mass conversion of an endothermic value of the crystalline resin determined by DSC.

<9> A toner stored unit including:

the toner according to any one of <1> to <8> stored in the toner stored unit.

<10> An image forming apparatus including:

an electrostatic latent image bearer;

an electrostatic latent image forming unit configured to form an electrostatic latent image on the electrostatic latent image bearer; and a developing unit that stores a toner and is configured to develop the electrostatic latent image formed on the electrostatic latent image bearer with the toner to form a visible image, wherein the toner is the toner according to any one of <1> to <8>.

<11> An image forming method including:

forming an electrostatic latent image on an electrostatic latent image bearer; and developing the electrostatic latent image formed on the electrostatic latent image bearer with a toner to form a visible image, wherein the toner is the toner according to any one of <1> to <8>.

The present disclosure can solve the above-described various problems in the art, and can provide a toner having excellent storage stability and image adherence resistance as well as excellent low-temperature fixing ability.

What is claimed is:

1. A toner, comprising a binder resin, said binder resin comprising:

an amorphous polyester; and a crystalline polyester, wherein:

an amount of the crystalline polyester in the binder resin is from 1% by mass through 20% by mass, based on a total mass of the binder resin; and an amount of heat of crystallization from the crystalline polyester in a range of from 40° C. through 70° C.

during a cooling process is from 1.0 J/g through 15 J/g in differential scanning calorimetry performed under conditions below:

<measuring conditions> after maintaining the toner at −20° C., heating the toner to 130° C. at 10° C./min (a first heating process), after maintaining the toner at 130° C. for 1 minute, cooling the toner to −50° C. at cooling speed of 10° C./min (the cooling process), and after maintaining the toner at −50° C. for 5 minutes, heating the toner to 130° C. at 10° C./min (a second heating process);

the crystalline polyester has a weight average molecular weight of from 10,000 through 35,000 and a melting point of from 60° C. through 120° C.; and the toner satisfies Formula (1) below in the differential scanning calorimetry:

$$(Mt_{2nd}/Mt_{1st}) \geq 0.70 \quad (1),$$

where $Mt_{1st}$ is an amount of heat of fusion (J/g) in the first heating process and $Mt_{2nd}$ is an amount of heat of fusion (J/g) in the second heating process.

2. The toner according to claim 1, wherein a crystallization peak temperature during the cooling process is 40° C. or higher.

3. The toner according to claim 1, wherein the toner satisfies Formula (2) below in the differential scanning calorimetry:

$$-5° \text{ C.} \leq (Tg_{1st} - Tg_{2nd}) \leq 5° \text{ C.} \quad (2),$$

where $Tg_{1st}$ is a glass transition temperature (° C.) in the first heating process and $Tg_{2nd}$ is a glass transition temperature (° C.) in the second heating process.

4. The toner according to claim 1, wherein the amorphous polyester has a weight average molecular weight of from 5,000 through 35,000 and a glass transition temperature of from 50° C. through 80° C.

5. The toner according to claim 1, wherein the crystalline polyester has a weight average molecular weight of from 13,000 through 25,000.

6. The toner according to claim 5, wherein an amount of the crystalline polyester is from 3 parts by mass through 20 parts by mass relative to 100 parts by mass of the binder resin.

7. The toner according to claim 1, an amount of the crystalline polyester is 1% by mass or greater but 20% by mass or less in the toner based on a value obtained through mass conversion of an endothermic value of the crystalline resin determined by DSC.

8. A toner stored unit, comprising:

the toner according to claim 1 stored in the toner stored unit.

9. An image forming apparatus, comprising:

an electrostatic latent image bearer;

an electrostatic latent image forming unit configured to form an electrostatic latent image on the electrostatic latent image bearer; and a developing unit that stores the toner of claim 1 and is configured to develop the electrostatic latent image formed on the electrostatic latent image bearer with the toner to form a visible image.

10. An image forming method, comprising:

forming an electrostatic latent image on an electrostatic latent image bearer; and developing the electrostatic latent image formed on the electrostatic latent image bearer with the toner of claim 1 to form a visible image.

* * * * *